US005382067A

United States Patent [19]

Baumann

[11] Patent Number: 5,382,067

[45] Date of Patent: Jan. 17, 1995

[54] SDE LATCH INTERCONNECT APPARATUS AND METHOD FOR TRANSPORTING A CONTAINER

[76] Inventor: James A. Baumann, 16413 Grant Ave., Orland Park, Ill. 60606

[21] Appl. No.: 209,487

[22] Filed: Mar. 14, 1994

Related U.S. Application Data

[63] Continuation of Ser. No. 989,338, Dec. 11, 1992, abandoned, which is a continuation-in-part of Ser. No. 945,747, Sep. 16, 1992, and Ser. No. 973,723, Nov. 9, 1992, Pat. No. 5,332,274.

[51] Int. Cl.[6] ..... B66C 1/62

[52] U.S. Cl. ..... 294/68.3; 294/67.33; 294/81.62; 414/460

[58] Field of Search ..... 294/67.3, 67.31, 67.33, 294/68.1, 68.3, 81.1, 81.2, 81.21, 81.51, 81.54, 81.6, 81.62, 119.1, 907; 414/459, 460, 560, 607

[56] References Cited

U.S. PATENT DOCUMENTS

| | | | |
|---|---|---|---|
| 1,516,973 | 11/1924 | Loughran | 294/81.62 |
| 2,191,445 | 2/1940 | Armington . | |
| 2,457,841 | 1/1949 | Smith et al. . | |
| 2,478,192 | 8/1949 | Harker . | |
| 2,547,502 | 4/1951 | Smith et al. . | |
| 2,904,370 | 9/1959 | Meinholtz et al. . | |
| 3,128,117 | 4/1964 | Abolins . | |
| 3,154,203 | 10/1964 | Barry | 294/68.3 X |
| 3,262,729 | 7/1966 | Willison et al. | 294/68.3 |
| 3,375,950 | 4/1968 | Chieger . | |
| 3,455,476 | 7/1969 | Grigsby | 294/67.3 |
| 3,567,266 | 3/1971 | Bridge . | |
| 3,983,926 | 10/1976 | Müller | 294/67.33 X |
| 4,035,010 | 7/1977 | Kawashita et al. | 294/81.62 |
| 4,244,615 | 1/1981 | Brown | 294/81.51 |
| 4,358,145 | 11/1982 | Svensson . | |
| 4,563,031 | 1/1986 | Kishimoto et al. | 294/81.21 |
| 4,583,902 | 4/1986 | Riley | 294/119.1 X |
| 4,728,234 | 3/1988 | Reynard . | |
| 4,854,807 | 8/1989 | Bishop . | |
| 4,968,080 | 11/1990 | Kerry . | |

FOREIGN PATENT DOCUMENTS

| | | | |
|---|---|---|---|
| 283121 | 9/1988 | European Pat. Off. . | |
| 402976 | 12/1990 | European Pat. Off. | 294/81.62 |
| 2197296 | 1/1990 | United Kingdom . | |
| 9213782 | 8/1992 | WIPO . | |

*Primary Examiner*—Dean J. Kramer

[57] ABSTRACT

An arrangement for coupling hoisting equipment with containers, and particularly to a side latch interconnect apparatus and method for expediting the interaction of hoisting equipment with containers and making such equipment more reliable. The arrangement includes: a rectangular framing structure adapted for coupling to a container lifting device; a latching mechanism for releasable latching onto a side of a container to provide a substantially vice grip-like engagement coupled to and extending downwardly and inwardly from the framing structure to sufficiently reach a side portion of the container without extending into the cargo space of the container, and a retractable interconnectable device for lateral adjustment of the latching mechanism.

23 Claims, 9 Drawing Sheets

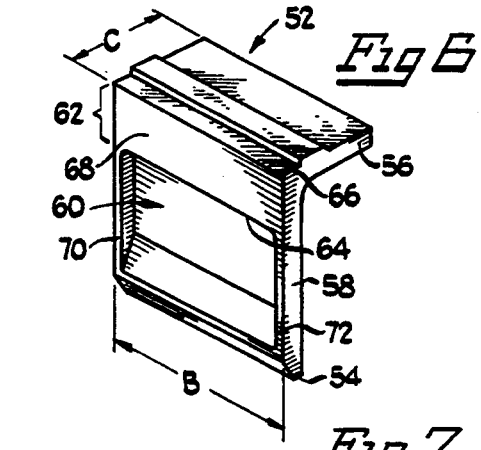
Fig 6
Fig 7
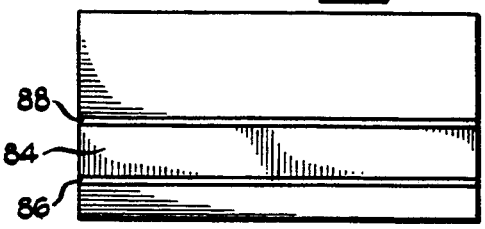
Fig 8
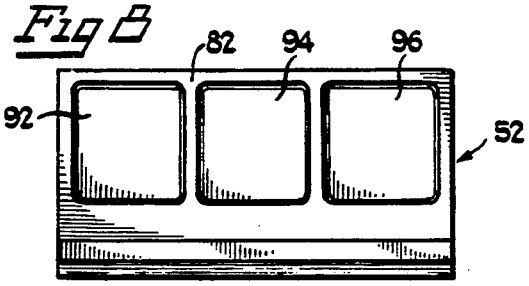
Fig 9
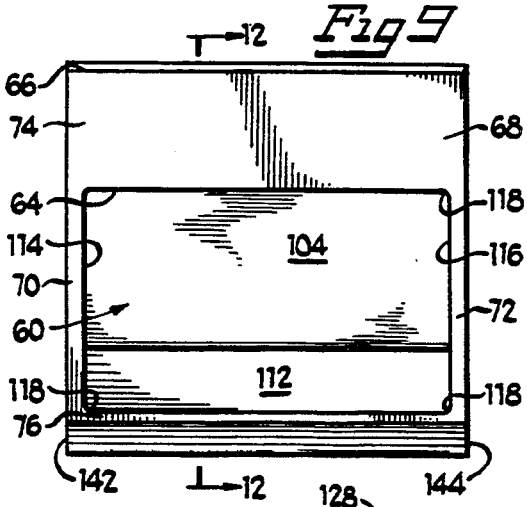
Fig 10
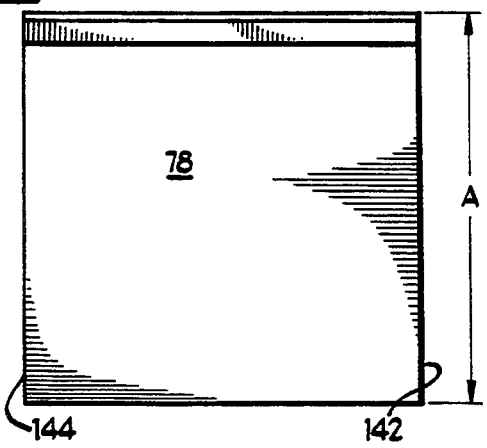
Fig 13
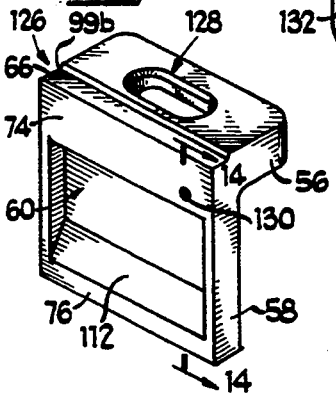
Fig 14
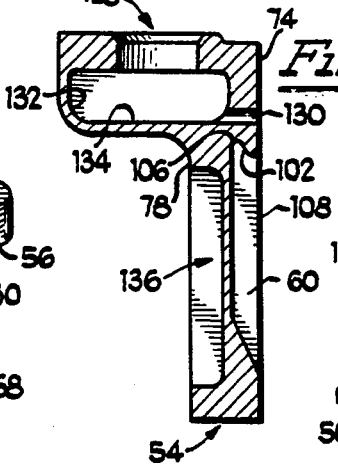
Fig 5
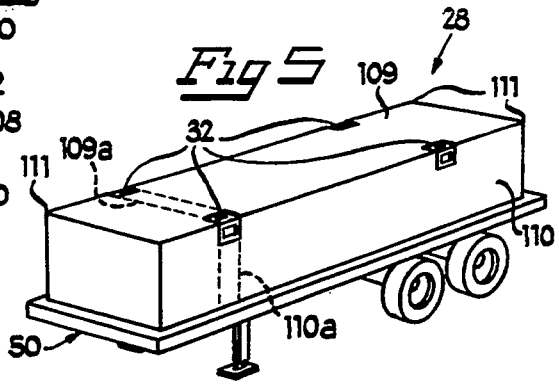

SDE LATCH INTERCONNECT APPARATUS AND METHOD FOR TRANSPORTING A CONTAINER

CROSS-REFERENCE TO RELATED APPLICATION

This application is a continuation of Ser. No. 07/989,338, filed Dec. 11, 1992, now abandoned, which is a continuation-in-part of pending application Ser. No. 945,747, filed Sep. 16, 1992 and pending application Ser. No. 973,723, filed Nov. 9, 1992 now U.S. Pat. No. 5,332,274.

TECHNICAL FIELD

This invention relates to the handling of freight in cargo containerization and arrangements for coupling of containers and hoisting equipment, and particularly to a side latch interconnect apparatus and method for expediting the interaction of hoisting equipment with containers and making such equipment more reliable.

BACKGROUND OF THE INVENTION

The intermodal industry has been streamlining to meet shipper's demands for quality service. Equipment manufacturers, truck load carriers and railroad lines play important roles in this process of rationization. Rationization, in the intermodal industry, involves the process of optimizing rotates, rate services and equipment.

Efforts to simplify and expedite handling for rail and truck carriers have been attempted in the past. There are on-going efforts to hake universal trailers, containers and attachments therefor, to allow trucking companies, shippers and the railroad to work together to flourish.

The benchmark of intermodal service combines the road effectiveness of truck transport with the cost effectiveness of double-stacked rail transport. Service and price, not mode, are strong considerations for shippers. Shippers also have the following goals: on-time delivery, complete deliveries, reduced transit times to meet a predetermined order cycle schedule; reduced inventory with more inventory turns; and flexibility.

To simplify their trailer fleets, there is a trend for trucking companies to convert to larger containers, such as 48- and 53-foot trailers, in an effort to standardize and lower costs.

Improvements in intermodal transportation can effect ocean carriers, as well as rail and truckload carriers. Recently, intermodal traffic has become more dispersed, and less concentrated around the ports. Thus, there is an increased demand for efficient service and improved equipment. Trains used in intermodal operations are shorter and are running more frequently. Thus, there appears to be a need for larger, high cube trailers, which may some day replace the 40-foot ISO container as the standard for intermodal equipment.

Choosing the right mode for the right load in this competitive environment, is now becoming more important than ever. A shipper's delivery requirements are considered along with availability of shipment mode-over-the-road and intermodal. Equipment availability, train schedules, distances and how to balance freight lines are some of the factors to be considered. A problem voiced in the intermodal industry, is that there are to many non-standard equipment sizes and types, resulting in inefficiencies in loading, reduced productivity of dock personnel, and freight damage. Therefore, there is a need to standardize equipment, containers and attachments therefor, which can be utilized universally, efficiently and effectively.

There is also a need to allow railroads and other transportation modes to work together to develop efficiencies, such as with new equipment, scheduling techniques and the like to allow shippers to be able to choose transport products via railroad, truck or a combination of both, without losing productivity, while maximizing weight and cube advantages. Accordingly, new technologies are needed and being created, such as the hoisting equipment of the present invention, that will expedite the transportation of containers and solve many of the problems plaguing this industry.

Efforts to expedite the handling of freight in cargo containerization or in arrangements for connecting containers and hoisting equipment, have been attempted in the past. To date, connecting mechanisms of satisfactory thinness have not been devised which substantially conform to wall or frame thickness of container walls and thus prevent or minimize intrusion into the pay load space of the container, or project beyond the outer contour of the container. Thin connections are desirable to increase the cubic space available for the pay load, while also providing an efficient and effective means to handle a container and expedite the interaction with hoisting equipment, for improved efficiency. Standard hoisting equipment, containers and container handles are desirable in view of the trend toward larger containers and the desire for faster and more reliable handling equipment thereof.

A desirable pick-up arrangement for a container resides in cooperating construction of a container, container handles and hoisting implements which enable coupling of the container and the implement and which simplifies the frame construction of the container and avoids undesirable protrusions into the lading space of the container.

As the lengths of containers are extended, the equipment is becoming increasingly important in terms of construction, ability to handle larger loads and maximizing cubic area for loading.

Accordingly, there is a need for container handling equipment and containers that will minimize the cost, space encroachment, complexities of container and hoisting equipment, construction, or weaknesses of the container handling equipment inherent in the devices and mechanisms presently known in the art.

It is therefore desirable to provide an improved hoisting equipment, containers, and container handles, which overcomes most if not all of the problems facing this and related industries.

SUMMARY OF THE INVENTION

This invention involves a releasable latch apparatus for releasable connection to a container having a lower engagable portion and an upper engagable portion, comprising a housing and latching mechanism for releasable latching engagement including a lower engagement member and an upper engagement member adapted for cooperating with the respective lower and upper engagable portions of the container for releasably gripping a container, coupled to the housing.

In a preferred embodiment, the upper engagement member and the lower engagement member of the latching mechanism are substantially vertically aligned with respect to each other to contribute to further structural integrity of a container when in transport.

Also in one embodiment, at least two latching mechanisms are coupled in tandem to define a retractable interconnecting mechanism for expedited and more reliable clampable engagement with a container.

This invention also involves a hoisting attachment for use with a lifting apparatus and for releasable connection to a container having a lower engagable portion and an upper engagable portion, comprising: a framing mechanism for coupling to a lifting apparatus; and a latching mechanism for releasable latching engagement with a container including a lower engagement member and an upper engagement member adapted for cooperating with the respective lower and upper engagable portions of a container for releasably gripping a container, coupled to the framing means.

In one embodiment, the latching mechanism is adapted for releasably engaging the container having handles including a lower engagable portion and an upper engagable portion, the lower and the upper engagement members of the latching mechanism cooperating with the lower and the upper engagable portions of the handles for releasably gripping the container.

In a preferred embodiment, the framing mechanism includes end portions including retractable interconnecting mechanisms for positioning the latching mechanism in proximity to a container, each retractable interconnecting mechanism includes tandem latching mechanisms.

In one embodiment, pivotable interconnectable mechanisms having a stowed position when not in use and an active position for use are utilized.

This invention also involves a side-latch hoisting attachment for use with a lifting apparatus and for releasable connection with a container accompanied with container handles having a lower engagable portion, comprising: a framing mechanism for coupling to a lifting apparatus, and supporting a plurality of laterally spaced latching mechanisms for releasably transporting a container, the distance between said latching mechanisms defining a width; each of the plurality of latching mechanisms includes arms having a lower engagable member; retractable interconnecting mechanisms for adjustably varying the width between the latching mechanisms and interconnecting the latching mechanisms with a container; and the lower engagable member of the arm adapted for engaging at least a portion of the lower engagable portion of the container handle for transporting a container to a desired location.

In one embodiment, the lower engagable member includes a distal end portion including at least an elongated pin device or a substantially upwardly facing member including a linear apex adapted to be coupled to a container handle for receiving the pin or linear apex.

In a preferred embodiment, the retractable interconnecting mechanism includes a linear guide for guiding movement therealong, and a linear bearing for allowing the linear guide to travel therealong.

The instant invention also involves a method of transporting a container, comprising: positioning a lifting apparatus in proximity to a container; latching the container in a substantially vertical direction with a plurality of releasable latching mechanisms; and transporting and releasing the latched container to a desired location.

In a preferred embodiment, the positioning step includes clamping the container by adjusting the width, defined as the distance between adjacent latching mechanisms, in a substantially horizontal-inwardly direction.

The invention also involves a handle for mounting on a container for use with a releasable latch mechanism having at least a lower engagement member, the container handle comprising, a body including a substantially vertical member having an outwardly facing surface having a lower engagable portion having a lower engagement surface, said lower engagement surface adapted for cooperating with the lower engagement member of the latch mechanism for releasably gripping the handle.

In a preferred embodiment, the outwardly facing surface includes an upper engagable portion having an upper engagement surface adapted for cooperating with an upper engagement member associated with the latch mechanism for releasably gripping the handle.

In a preferred embodiment, the outwardly facing surface of the handle has a recess adapted to receive at least a portion of a complementarily configured lower engagement member of the latch mechanism to facilitate the interaction between the two components.

In a preferred embodiment, the recess has a substantially bell shaped or inverted V with a semi-circular upper portion geometry.

In a preferred embodiment, the upper engagement surface and the lower engagement surface are substantially vertically aligned with each other and between the outer and inner facing surfaces of the substantially vertical member, to minimize any undesirable moments therein.

Also in a preferred embodiment, the lower engagement surface provides a large rectangular area to receive the lower engagement member of the releasable latch mechanism for providing substantially concentric loading across such surface, for improved integrity, and minimization of any unwanted moments when loaded.

In a preferred embodiment, four container handles are coupled to a container at the sidewalls and header thereof. The thin container handle profile and container for use with the present handle, are constructed to provide a high cubic area, and low weight to maximize the pay load available to be transported.

The side latch interconnect system described herein in conjunction with the four fixed handles, provide increased structural assistance to the container, for increased durability and integrity, and allows for lower weight and thin wall construction of the container.

BRIEF DESCRIPTION OF THE DRAWINGS

FIG. 5 is a perspective view of a removable container on a truck chassis, accompanied with a plurality of container handles in normal use in accordance with the present invention.

FIG. 6 is an enlarged perspective view of the container handle of the present invention.

FIG. 7 is a top plan view of the container handle shown in FIG. 6 in accordance with the present invention.

FIG. 8 is a bottom plan view of the container handle shown in FIG. 6 in accordance with the present invention.

FIG. 9 is a front elevational view of the container handle shown in FIG. 6 in accordance with the present invention.

FIG. 10 is a rear elevational view of the container handle shown in FIG. 6 in accordance with the present invention.

FIG. 13 is an enlarged perspective view of an alternate embodiment of a container handle accompanied with a top pocket in accordance with the present invention.

FIG. 14 is a sectional view of the container handle of FIG. 13 taken along the lines 14—14 of FIG. 13 in accordance with the present invention.

DESCRIPTION OF THE PREFERRED EMBODIMENT

Figure 1:
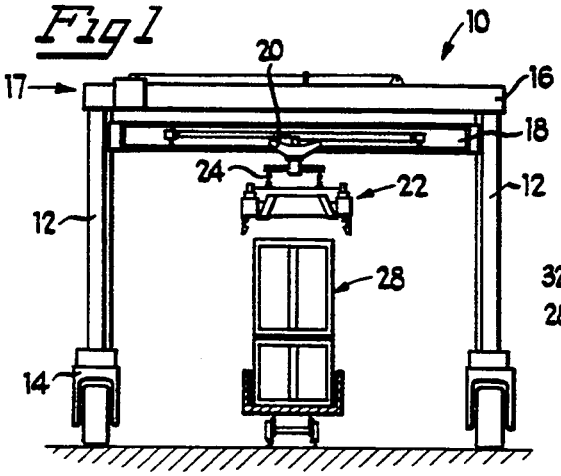
FIG. 1 is a front elevational view of a lifting apparatus in the form of a gantry crane accompanied with a side latch interconnect system capable of engaging a plurality of container handles attached to an upper side portion of a container or truck trailer, in accordance with the present invention.

Referring to FIG. 1, there is shown a lifting apparatus in the form of a gantry crane 10. The lifting apparatus includes a plurality of interconnected horizontal and vertical beams to form an open-centered frame for straddling and trans,porting containers, truck trailers and the like.

The apparatus 10 includes upright corner columns 12 supported by pivotally attached wheel assemblies 14, with suitable drive means (now shown) for moving the apparatus 10 along a ground surface. The apparatus 10 further includes a plurality of horizontal beams, including lower and upper horizontal cross beams 15 and 16 connecting columns 12. The upper horizontal cross beams 16 define part of an upper portion 17 of apparatus 10. In one embodiment, there are four beams 16 coupled to the front and rear columns 12 and there are two lower horizontal cross beams 15 adjacent the wheel assemblies 14, connecting the front and rear columns on each side of apparatus 10. As shown in FIG. 1, the apparatus 10 can be readily maneuvered over a stack of containers, for lifting and transporting containers to various locations as needed.

In FIG. 1, the apparatus 10 further includes an elevatable horizontal stabilizer beam 18 movably coupled to the upper portion 17, for allowing a load such as a container to be raised or lowered. Coupled to the stabilizer beam 18 is a trolley mechanism 20, for allowing horizontal or lateral movement thereof. The trolley mechanism 20 includes a side latch interconnect system 22 coupled by connection structure 24 in the form of a direct hanging chain 24 in FIG. 1.

The apparatus 10 is particularly adapted for movement along a transportation work place, such as, a plurality of roadways, railroad tracks and like, so as to enable intermodal transfer of trailers and containers from trucks to railroad freight cars or vice versa and the like.

Figure 2:
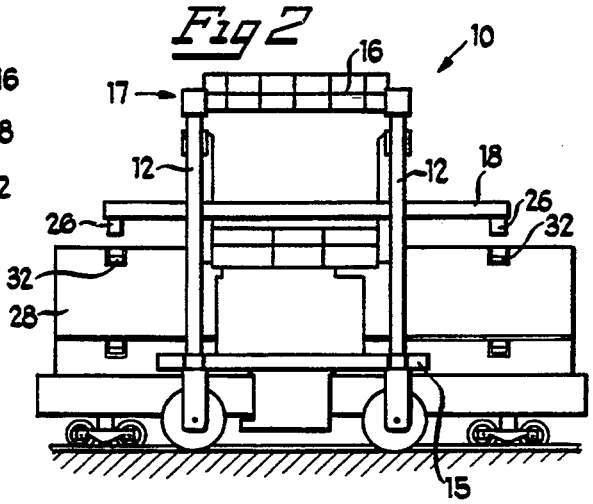
FIG. 2 is a side elevational view of the lifting apparatus and two containers or a double-stacked railroad car, the containers having container handles attached to an upper side portion thereof as shown in FIG. 1, and in accordance with the present invention.

In FIG. 2, the side latch interconnect system 22 includes two tandem transverse releasable latch mechanisms 26 for positioning and placement above and adjacent to the roof or header of a container 28.

Figure 3:
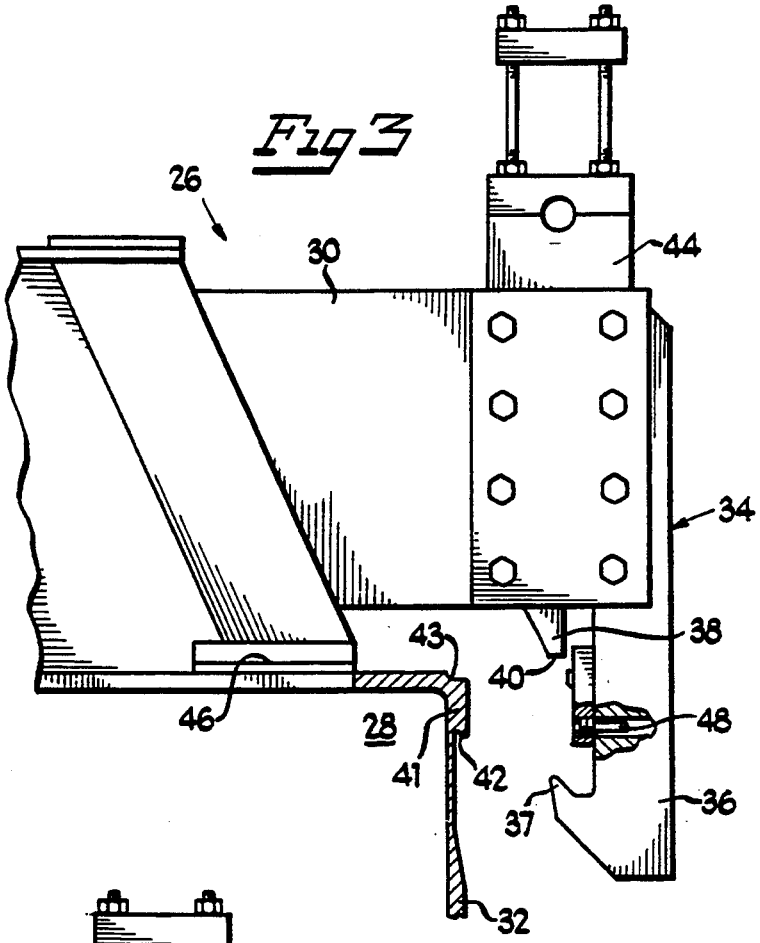
FIG. 3 is a partial, enlarged front elevational view of the side latch interconnect system and a cross-sectional view of the container handle in FIGS. 1 and 2, showing a releasable latch mechanism in a disengaged position with respect to the container handle in accordance with the present invention.

Referring to FIG. 3, each releasable latch mechanism 26 includes at each distal end an extendable, preferably telescopic, arm member 30 for movement laterally outwardly or inwardly, substantially in a horizontal direction, beyond the width of the container 28. In FIG. 3, the latch mechanism 26 is shown in a disengaged position, and in FIG. 4, in an engaged position with respect to a container handle 32, which is suitably secured and anchored to container 28. This is referred to as "horizontal clamping".

Figure 4:
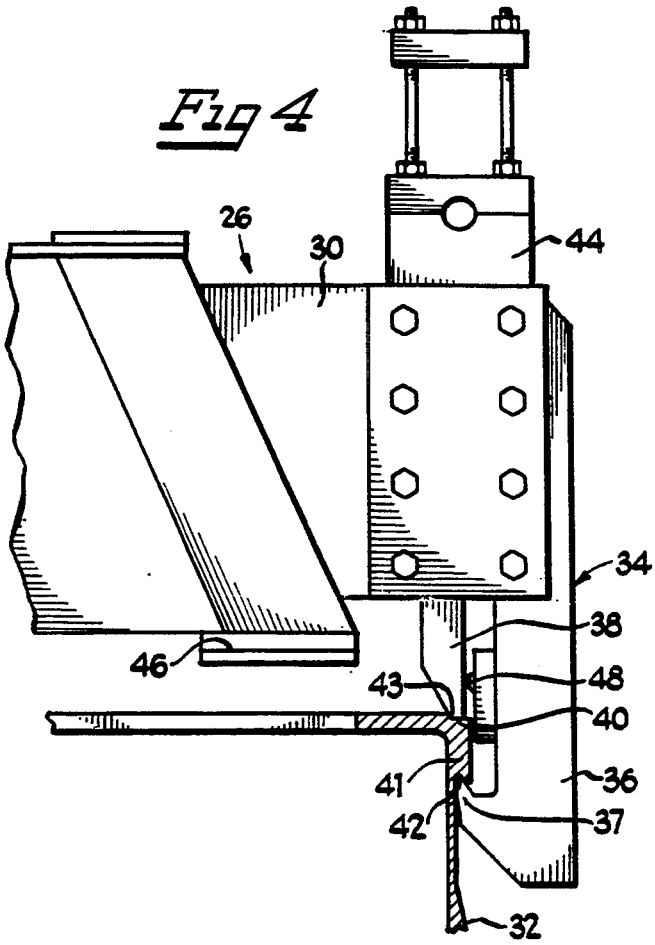
FIG. 4 is a partial, enlarged front elevational view of the side latch interconnect system and a cross-sectional view of the container handle in FIGS. 1 and 2, showing the releasable latch mechanism gripably engaged with and securely connected to the container handle in accordance with the present invention.

In FIGS. 3 and 4, the container handle 32 includes an engagable portion 41 comprising a lower engagable portion 42 and an upper engagable portion, as described more fully below.

In FIGS. 3 and 4, each releasable latch mechanism 26 includes a generally backward "L-shaped" arm 34 which is capable of being moved into and out of engagement with the container handle 32. The arm 34 includes a lower engagable member 36 with an outer end portion 37. In one embodiment, the end portion 37 forms an upwardly projecting hook, which is configured to cooperate with and at least partially complementary with the lower engagable portion 42 of the container handle 32, to facilitate the coupling and decoupling of the latch mechanism 26 with the container handle 32 and the container 28 accompanied with the handle 32.

The latch mechanism 26 further includes an upper engagable member 38 in the form of a vice or retention bar having a lower end 40 for engagement with an upper engagable portion 43 of the container handle 32, as described in further detail below. The upper engagable member 38 of the latch mechanism 26 and the upper engagable portion 43 of the container handle 32 are configured to cooperate with and be at least partially complementary with each other, to facilitate coupling and decoupling of the latch mechanism 26 with the container handle 32.

The upper engagement member 38 is operable in a vertical direction, upwardly and downwardly, by a power means 44, preferably in the form of a hydraulic cylinder or other suitable means, so as to apply a vector force downwardly against the upper engagable portion 43 of the container handle 32, for secure engagement of the latch mechanism 26 with the container handle 32.

In one embodiment, the lower and upper engagable portions 42 and 43 of container handle 32 are substantially complementary with respect to the lower and upper engagement members 36 and 38 for improved interconnection and releasable coupling and decoupling therebetween, respectively.

In operation, the apparatus 10 is suitably positioned over and about a truck trailer or cargo container 28, as shown in FIG. 2. Next, the stabilizer beam 18 is adjusted vertically to position each latch mechanism 26 about and in proximity to the container handles 32, preferably at four upper side locations on the container 28. The extendable arm members 30 are typically in an extended position extending outwardly beyond the width or sidewalls of the container 28 as shown in FIG. 3. The stabilizer 18 is then moved vertically downwardly until a mounting mechanism 46 senses or contacts the header or roof of the container 28, thereby positioning the interconnect system 22 with the latch mechanism 26 in a service position, as shown in FIG. 3. The extendable arms members 30 are then retracted or moved horizontally inwardly toward the container handle 32 as appropriate, to clamp the container. In one embodiment, an alignment sensor 48 on FIG. 3, positions the lower engagement member 36 end portion 37 adjacent and just below the lower engagable portion 43 of the container handle 32, as shown in FIG. 4. Thereafter, the upper engagement member 38 is moved downwardly against the upper engagable portion 43 of the container handle 32, thereby simultaneously causing the lower engagement member 36 to be drawn upwardly into contact with the lower engagable portion 42 of the container handle 32, as shown in FIG. 4. This results in a vertical force pressing downwardly on the upper engagable portion 43 of the container handle 32 and a substantially equal vertical force pressing upwardly on the lower engagable portion 42, from the upper and lower engagement members 38 and 36, respectively, so as to hold the container handle 32 in a vise grip-like connection. This is referred to as "vertically latching" the latch mechanism 26 with the container handle 32.

In one embodiment, this occurs at, at least two locations and preferably at four external locations, as shown in FIG. 5. Consequently, the apparatus 10 is capable of lifting and transporting a truck trailer or container 28 from its side, and placing it on or lifting it off another container, railroad car .Dr the like, as shown in FIG. 1. The term "container" as used herein can include and is not limited to any kind of container, truck trailer, ISO containers, and the like, preferably containers that are utilized in the railroad and trucking industries for improved reliability and efficiency.

In FIG. 5, a removable container 28 is shown, including a plurality of container handles 32 mounted at predetermined locations on the container 28 and spaced apart so as to provide a pre-determined span length therebetween. In one embodiment, the container 28 is removable from a truck chassis. The container handle 32 of the instant invention can be utilized in a wide variety of containers, and are particularly adapted for use with long containers, such as those about 48 or 53 feet long for larger pay loads. The handles 32 are particularly adapted for lighter weight containers, for fuel savings over the road, similar to the airline industry. Similarly, the span lengths of the container handles 32 as well as the vertical placement can vary widely. In one embodiment, the span length between the handles 32 about 40 feet for improved and efficient transporting thereof. Also, in one embodiment, a groove where the header and sidewalls meet along a portion or along the entire length of the container can be included, with handles 32 spaced there below to facilitate handling while allowing larger and higher cube containers or trailers to pass through narrow and low train tunnels, bridges, current envelope restrictions, and the like. The center of the container defines and axial axis with the container handle 32 being in alignment with such axis.

Figure 11:
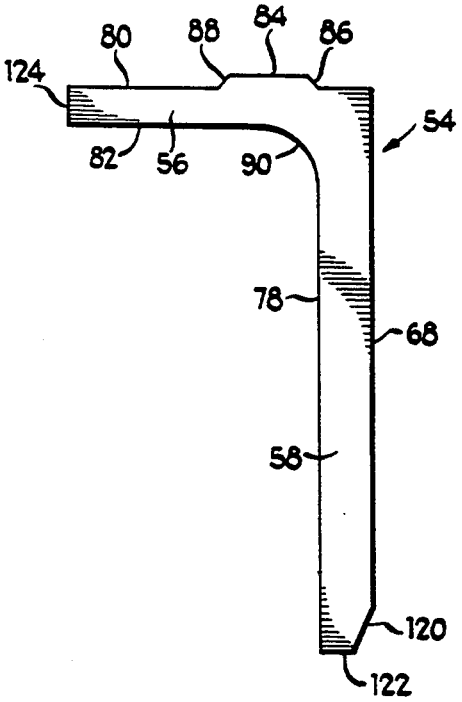
FIG. 11 is a side elevational view of the left side of the container handle shown in FIG. 6, the right side being a mirror image of the left side, in accordance with the present invention.

In the embodiment shown in FIG. 6, a container handle 52 is shown which includes a body 54 including a substantially horizontal flange member 56 and a substantially vertical flange member 58 having a recess 60. The substantially horizontal member 56 and the vertical member 58 are connected by an intermediate engagable portion 62, having a lower and an upper engagable portion 63 and 65 with a lower and an upper engagement surface 64 and 66, respectively, for allowing a vise-grip like or C-clamp like gripable engagement thereof. As best shown in FIG. 11, the body 54 profile, is substantially narrow and includes an inverted L-shaped member, to minimize the space necessary for use with a container 28, thereby providing minimal intrusion into the interior of a container, resulting in maximizing the cubic space available for loading a container.

Figure 12:
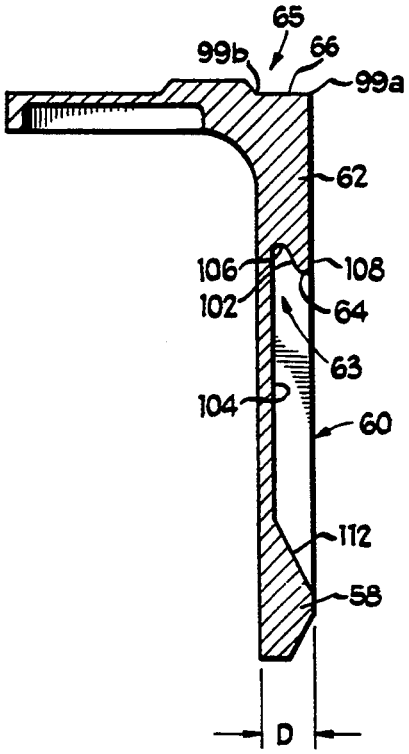
FIG. 12 is a sectional view of the container handle shown in FIG. 6, taken along the lines 12—12 of FIG. 9 in accordance with the present invention.

In a preferred embodiment, the container handle 32 in FIG. 3, item 52 in FIG. 6 or item 126 in FIG. 13, is mounted on container 28 for use with a releasable latch mechanism 26 having lower and upper engagement members 36 and 38. In FIG. 6, the container handle 52 includes an aerodynamic body 54 including a substantially vertical member 58 having an outwardly facing surface 68 having a lower engagable portion 63 having a lower engagement surface 64 and an upper engagable portion 65 having an upper engagement surface 66, the lower and the upper engagement surfaces 64 and 66 are configured and adapted for cooperating with the respective lower and upper engagement members 36 and 38 of the releasable latch mechanism 26 for releasably gripping, vice-gripping, latching or coupling of the container handle 52. The container handle 52 is configured with a narrow profile to minimize intrusion into the interior of a container, thereby maximizing the cubic area available for loading, as illustrated in FIGS. 3, 11 and 12. More particularly, the upper engagable portion 65 with a horizontal flange member 56 and the vertical member 58 with the lower engagable portion 63, are configured to minimize intrusion into the container 28 in FIG. 5.

The container handle can be manufactured in various ways, such as from machining a plate, forging or casting. In a preferred embodiment, the container handle of this invention is integral or cast by pouring a liquid into a mold and allowing it to harden, preferably a metallic material is used. It is believed that a container handle 52 made by casting, forms an integral, compact and narrow profile of the desired geometry with the necessary integrity and properties to withstand substantial axial stresses, torsional stresses and bending moment stresses and the like, with an improved grain structure, yet minimizes the profile necessary to minimize intrusion into the interior of a container.

Referring to FIG. 9, the vertical member 58 includes an outwardly facing surface 68 including reenforcing vertical guides 70 and 72 on either side of the recess 60, when the recess 60 is in the form of a rectangular pocket. In one embodiment, the recess 60 as well as the outwardly facing surface 68 on the top and bottom, and guides and 70 and 72 on the sides have substantially the same geometric shape, such as rectangular, for a smooth transition of the tension or pulling forces when lifting a heavy load in a container. The recess 60 provides a wide area or large target profile for an operator to aim the lower engagement member 36 of the latch mechanism 26, for facilitating handling. In FIG. 9, the outwardly facing surface 68 further includes an upper and a lower portion 74 and 76, as well as the left and right guides 72 and 74. The guides 72 and 74 are configured to help an operator interconnect the latch mechanism 26 to the container handle 52.

Referring to FIG. 11, opposite the outwardly facing surface 68, is an inwardly facing surface 78. Similarly, the horizontal member 56 includes an upwardly facing surface 80 and downwardly facing surface 82 opposite thereof. In FIG. 9, the container handles 52 includes left and right sides 142 and 144 defining the left and right boundaries thereof.

In one embodiment, the horizontal member 56 of the upper engagable portion 65 includes an upwardly facing elongated abutment 84 extending longitudinally in alignment with and parallel to the longitudinal axis B, in FIG. 6. The abutment 84 includes an outer inclined surface 86 and an opposite inner inclined surface 88, as shown in FIG. 11. The abutment 84, and particularly the outer inclined surface 86, are configured to direct and align the upper engagement member 38 of the latch mechanism 26 with the upper engagement surface 66, for forming a secure key engagement therebetween, and for proper gripping of the handle 52 between lower and upper engagement surfaces 64 and 66, thereby allowing the lower and upper engagement members 36 and 38 to apply equal and opposite vertically aligned vector forces for secure clamping to lower and upper engagement surfaces 64 and 66, respectively.

The inclination of surface 86 with respect to upper engagement surface 66 can vary widely, preferably from about 90° to about 180°, and most preferably from about 125° to about 145°; for efficient alignment and a smooth transition of forces when under load. Also preferred, the inner inclined surface 88 is a mirror image of surface 86 for uniformity of the abutment 84 along and across the upper engagable portion 65.

Opposite the abutment 84 is a curved, concave and linear section 90 for a smooth transition from the downwardly facing section 82 and inwardly facing surface 78 of the body 54, for a smooth transition of forces and structure whether under load or not.

In one embodiment, the downwardly facing surface 82 includes first, second and third rectangular indentations 92, 94 and 96, to minimize the overall weight of the container handle 52 in FIG. 8.

The engagable portion 62 in FIG. 12, is configured to include an upper engagement surface 66, a lower engagement surface 64 opposite and vertically aligned with the upper engagement surface 66. In addition, the lower engagement surface 64 is adjacent to the recess 60. The lower and upper engagement surfaces 64 and 66 define a male member on the outwardly facing surface 68 on vertical member 58, for facilitating and improving gripable engagement thereof and therebetween. The male member extends horizontally along the vertical member 58, as shown in FIG. 9, to provide an extended, linear and horizontal contact area for connection with the latch mechanism 26. The upper engagement surface 66 further includes an outer section 99*a* in the form of an apex and an inner section 99*b* in FIG. 12.

In a preferred embodiment, the container handle 52 is suitably connected to a container 32 where the sidewall and header meet. In such embodiment, the lower and upper engagement surfaces 64 and 66 are substantially vertically aligned with a sidewall with or without an appropriate container framing means, so that when container handle 52 is being utilized to lift a container, substantially most of the tension or pulling forces are substantially vertically aligned through and parallel to the vertical member 58 and sidewall and/or framing means. Preferably, most of the pulling forces run vertically through the container handle 52, defined as between the outwardly and inwardly facing surfaces 68 and 78 and the left and right sides 142 and 144, and most preferably through the lower engagement surface 64 in proximity to the transition section 106, to substantially minimize any unwanted moments.

The lower engagement surface 66 is configured to provide a large area for substantially concentric vertical loading, when lifting a load, thereby minimizing any undesirable bending moments. This allows a manufacturer to make a lighter weight container with substantial integrity, which requires less, interconnecting structure for fuel economy.

In one embodiment, the lower engagement surface 66 includes an inclined surface 102 adjacent to a base 104 of the recess 60. The lower engagement surface 64 and the base 104 meet to form an inner concave transition section 106, as shown in FIG. 12. In one embodiment, the inner transition section 106 is substantially linear and horizontal along a substantial portion of the vertical member 58.

In one embodiment, the concave section 106, provides a linear and horizontal pick point for engagement with a complementary lower end 40 of the lower engagement member 36 of the latch mechanism 76. The lower engagement surface 66 further includes an outer-convex transition section 108, which is substantially linear and horizontal to provide a smooth surface for receiving or catching a lifting mechanism, and minimizing the possibility of damage to the section 108 when contacting a latch mechanism 26.

The term moment, as used herein, has its conventional meaning in mechanical engineering. Briefly, a moment refers to an externally applied force applied not in substantial alignment with a beam or other similar structure, such as a force applied offset or at an angle with respect to the beam and the neutral axis thereof. The lower engagement surface 64 of the container handle 52 provides a surface for lifting the handle 52, preferably with a container 28, which is in substantial vertical alignment with the vertical member 58, to minimize any moments. This allows the container to be made more cost effectively, lighter and with less supporting structure. More particularly, it is believed that the unwanted bending moments are minimized when the lower and upper engagement surfaces 64 and 66 are interconnected with latch mechanism 26, and the supporting forces when loaded run through the lower engagement surface 64 and run parallel to the vertical member 58. Furthermore, the side latch interconnect system described herein in conjunction with the four fixed handles, provide increased structural assistance to the container, for increased durability and integrity, and allows for lower weight and thin wall construction of the container.

In engineering, sections where the bending moment is zero, are called points of inflection or contraflecture, or can be located by equating the equation for moments to zero at such sections. If a beam must be spliced, the splice should be located at or near a point of inflection if one is to minimize unwanted twisting forces or bending moments.

It is believed that the horizonal member 56 has an inflection point substantially aligned with and parallel to the header 109 and/or framing 109*a*, and the vertical member 58 has a contraflecture point aligned with and parallel to a sidewall 110 and/or framing 110*a* in FIG. 5. Thus, when loaded the container is supported vertically by the lower and upper engagement surfaces 64 and 66, resulting in minimizing unwanted moments to the handle 52 as well as the container, resulting in a longer useful life for the handle 52 and container. Similarly, the horizontal member 56 is configured to minimize any unwanted moments.

Advantageously, the lower engagement surface 64 provides a wide and linear concentricity loaded surface for lifting the container handle 52. It is believed that unwanted moments are minimized when the upper engagement member 38 of the latch mechanism 26 is latched to handle 52.

As should be understood by those skilled in the art, the container handle 52 of the instant invention, can be utilized for varying types of containers, but is particularly adapted to being utilized in conjunction with removable containers attachable to truck chassis and/or railroad cars, and the like in FIGS. 1 and 5. Also, as should be understood, in one embodiment, the container 28 can have an open top for material handling, for example.

In the embodiment shown in FIG. 5, a plurality of container handles 32 are coupled to the header 109 and sidewalls 110 of container 28, in proximity to the upper corners 111 thereof to provide a predetermined distance therebetween. Preferably, four container handles 32 are carefully coupled to and in alignment with the header 109 and sidewalls 110 using plating technology, for example, or horizontal and vertical framing posts 109*a* and 110*b* of container 28, respectively, as shown in phantom in FIG. 5. The framing 109*a* and 110*b* are interconnected with other framing of the container (not shown) to provide the necessary integrity. The container handles 52 are spaced apart to provide a fixed span length therebetween to facilitate handling and engagement thereof. Each of the container handles 32 are adapted for use with the releasable latch mechanism 26 having lower and upper engagement members 36 and 38, the upper and the lower engagement surfaces 66 and 64 of the container handles 32, are configured and adapted for cooperating with the respective upper and lower engagement members 38 and 36 of the latch mechanism 26 for releasably gripping the container handles 32 and container 28 in FIG. 5. The transition section 106 is aligned with a neutral vertical axis aligned with A in FIG. 10, defined as running through the middle of vertical member 58. In a preferred embodiment, the neutral axis is also aligned with the sidewalls 110 and/or framing 110*a*, for substantially minimizing unwanted bending moments, thereby minimizing distortions to the container upon lifting and extending its life.

Referring to FIG. 9, the pocket 60 further includes a lower inclined section 112 and side sections 114 and 116, the section 112 helps to direct the lower engagement member 36 of the latch mechanism 26 toward the base 104 of the recess 60 for proper alignment, thereby facilitating engagement. Once aligned, the side sections 114 and 116 of recess 60 and guides 70 and 72 contribute to keeping the latch mechanism 36 properly aligned until gripable engagement of the engagable portion 62 is completed. In one embodiment, the corners 118 are curved to provide a smooth transition of forces when being utilized to pick up heavy loads.

In FIG. 11, the vertical member 58 further includes an inclined section 120 and an end section 122 and the horizontal member 56 includes an end section 124, for suitable connection to the framing of a container 28 sidewall and header, respectively.

The container handle 52 is configured to align the vertical member 58 with the sidewalls 110 and the upper engagable portion 65 with the header 109. In a preferred embodiment, the lower and upper engagement surfaces 64 and 66 and the framing 110b are coupled and aligned to minimize unwanted moments when utilizing handle 52 by lifting the container 28. This is accomplished by vertically aligning the lower and upper engagement surfaces 64 and 66 with the framing **109*a* of sidewalls 109 so that the tension or pulling forces when under load or when container 28 is picked up, run through and are aligned vertically with vertical member 58, framing 109*a* and sidewalls 109, and thereby minimizing unwanted moments when lifting container handle 52**.

In one embodiment, the container handles of the present invention are substantially coextensive with the container 28 as shown in FIGS. 3 and 5. In a preferred embodiment, the horizontal member 56 is coextensive with and slightly recessed in the header 109 and the vertical member 58 is coextensive with and slightly recessed in the sidewalls 100, to provide an aesthetically pleasing aerodynamic container 28 design, accompanied with readily accessible handles.

The container handles of the instant invention can be used in a wide variety of applications, to simplify and improve the effectiveness of transporting containers, while minimizing intrusion within the containers, thereby maximizing the cubic area for loading the container.

Referring to FIG. 13, container handle 126 is shown, with an elongated rectangular aperture 128 aligned along an axial axis, on horizontal member 56. The aperture 128 is particularly adapted to receiving a locking device, such as an inter box connector for locking adjacent containers on a railroad car, as shown in FIG. 1.

The container handle 126 in FIG. 13 is substantially similar to the container handles 32 and 52 previously discussed. Thus, the same identification numbers as utilized to identify the same elements in container handles 32 and 52 are used for container handle 126. The container handle 126 in FIG. 14, further includes a drainage aperture 130, extending from the aperture 128 to the outwardly facing surface 68 of the upper portion 74, for draining water, dirt, melting snow and the like. In FIG. 14, the aperture 128 includes sidewall 132 and a base 134. In one embodiment, the inwardly facing surface 78 of the vertical member 58 includes a first, second and third elongated and rectangular indentation 136, 138 and 140, extending vertically, for minimizing the weight of body 54 (only 136 is shown in FIG. 14).

The profile and dimensions of the container handle 52 of the instant invention can vary widely.

For example, in one embodiment, the height parallel to a vertical axis A, in FIG. 10 ranges from about 14 to about 9 inches, preferably about 11.5, the width B in FIG. 6 is at least about 5 inches, preferably about 12 or 8 inches, with a recess width ranging from about 14 inches to about 4 inches, preferably about 11 or 7 inches, and the depth along horizontal axis C in FIG. 6 can vary widely, for example at least about 1 inch, preferably about 6 inches, and a thickness D in FIG. 12 of the vertical member of about three inches or less, preferably about 1 inch. The line identified as B in FIG. 6, as used herein, defines a longitudinal axis. As should be understood by those skilled in the art, the dimensions can be varied while still being within the scope of this invention.

The weight of the container handle 52 can vary widely based on material selection and dimensions. In one embodiment, the weight is at least about 5 lbs., preferably about 20 to 30 lbs. for steel, for minimizing the weight while maximizing the integrity.

The material utilized to make the container handle 52 can vary widely. The material however needs to be able to withstand the harsh environments and substantial loads and forces it will be exposed to. In a preferred embodiment, the material to make the container handle 52 comprises a metallic material having at least the following mechanical and chemical properties as specified in ASTM A-27, with minimum mechanical properties of Tensile: 70 KSI, and Yield: 40 KSI, or ASTM A-36, for structural integrity and a long useful life. As should be understood by those skilled in the art, other materials can be utilized, which meet or exceed these properties.

The metallic material utilized to make the container handle 52 can vary widely. In one embodiment, the metallic material includes a chemical composition with at least one member of the group consisting of carbon, manganese, silicon, sulfur and phosphorus and combinations thereof, preferably all are utilized for the desired properties, such as durability, structural integrity, and a long useful life. Preferably, the container handle 52 is cast in a mold with the above components, to form the desired geometry with a narrow profile and structural integrity.

Figure 15:
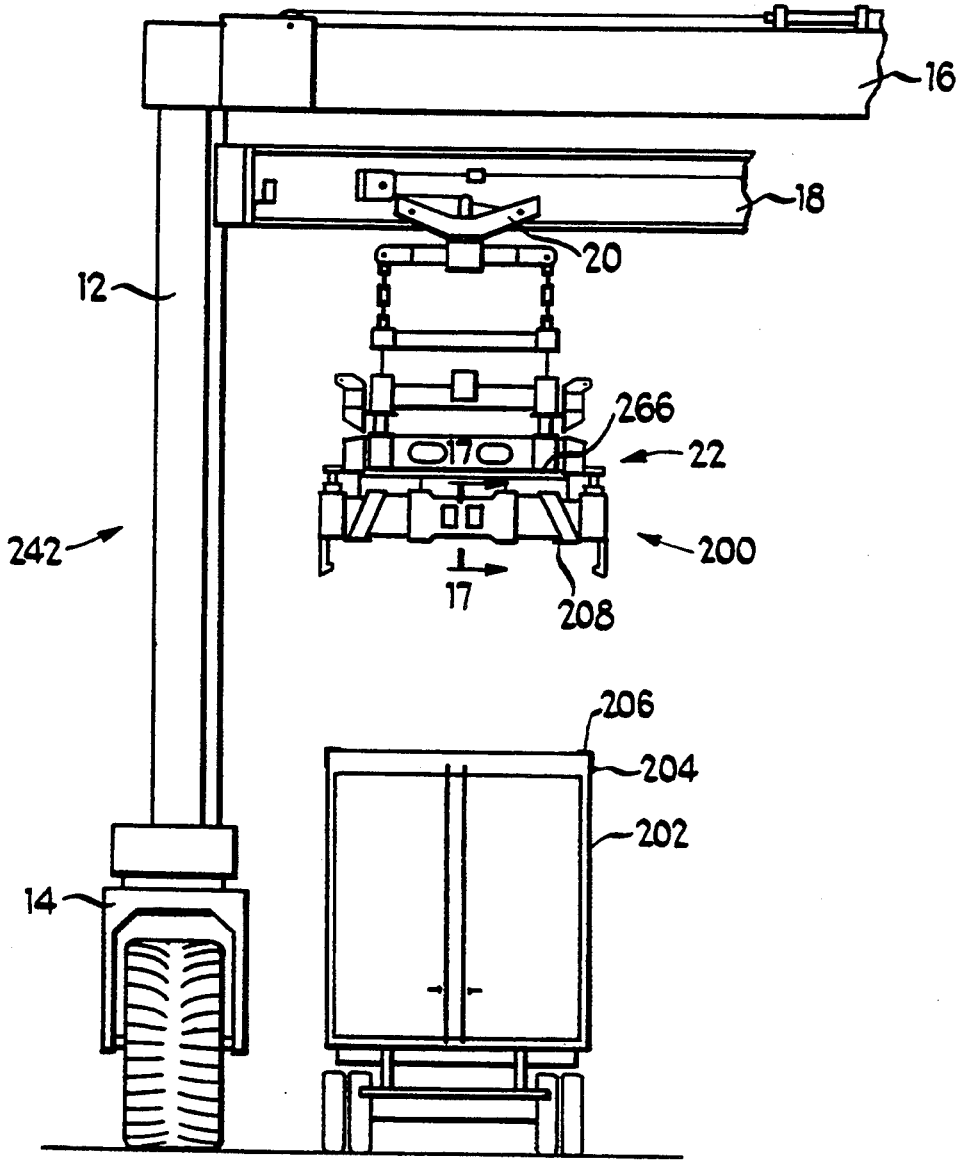
FIG. 15 is a partial front elevational view of a lifting apparatus in the form of a gantry crane accompanied with a latching apparatus capable of engaging and transporting a container in accordance with the present invention.
Figure 17:
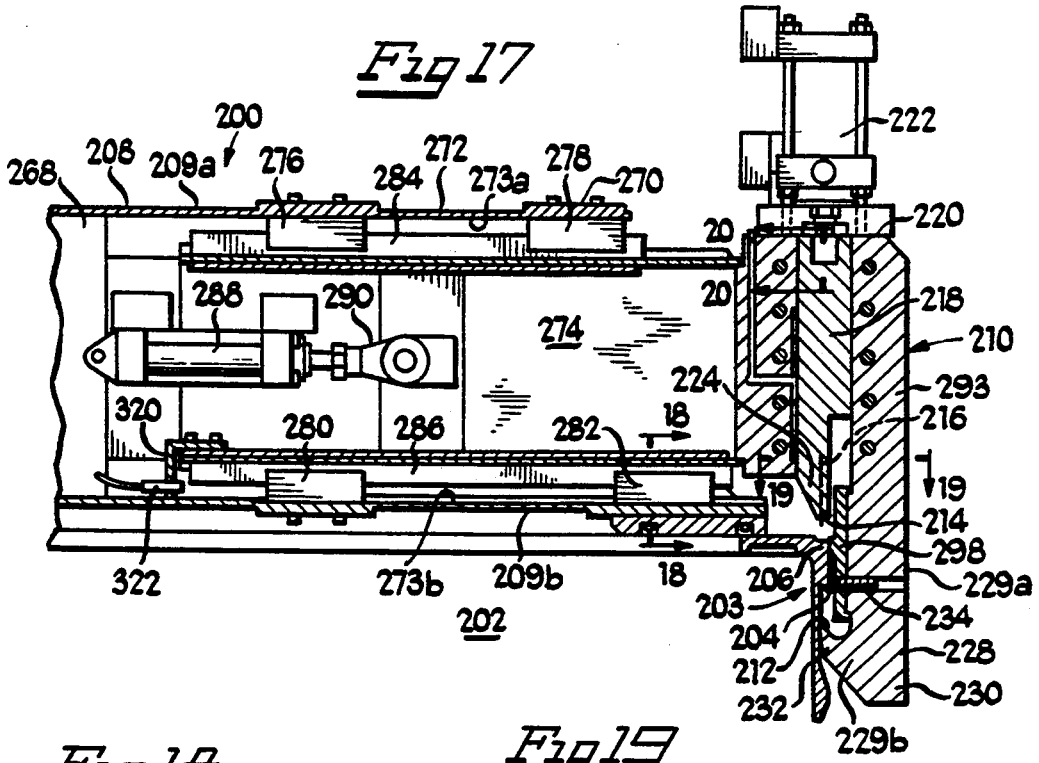
FIG. 17 is an enlarged sectional view taken along the lines 17—17 of FIG. 15 of the latch apparatus and a cross-sectional view of a container handle, showing the latch apparatus contacting the container, but not yet gripably engaged therewith, in accordance with the present invention.

Referring to FIGS. 15 and 17, a releasable latch apparatus 200 is shown. As used herein, the terms "side latch interconnect system" and "latch apparatus" and "latching mechanism" are used interchangeably to describe various aspects of the instant invention. The term system refers to the process or method including at times certain structure, and the latch apparatus and mechanism refers to the mechanical structure, of the present invention.

In FIG. 17, the latch apparatus 200 is adapted for releasable connection with a container 202 having a lower engagable portion 204 and an upper engagable portion 206. The latch apparatus 200 includes a housing 208 and a releasable latching mechanism 210 for releasable latching engagement, including a lower engagement member 212 and an upper engagement member 214 for cooperating with the respective lower and upper engagable portions 204 and 206 of the container 202 for releasably gripping a container 202, coupled to the housing 208. Advantageously, the housing 208 encloses many of the components of the latch apparatus 200, thereby minimizing the possibility of damage to the components therein. In one embodiment, the container 202 is accompanied with a plurality of handles or preferably four such handles, defined as container handle 203 herein, comprising the lower and upper engagable portions 204 and 206.

Also in a preferred embodiment, the lower and upper engagement members. 212 and 214 are substantially vertically aligned with respect to each other as shown in dashed line 216 in FIG. 17. This vertical alignment along line 216 allows the upper engaged member 214 to apply a vertical force pressing downwardly on the upper engagable portion 206 of the container handle 203 and a substantially equal vertical force pressing upwardly from the lower engagement member 212 on the lower engagable portion 204, so as to hold the container 202 and handle 203 in a vise grip-like connection. In one embodiment, this occurs at, at least two locations and preferably at four external locations, as shown in FIG. 5. Consequently, a lifting apparatus is capable of lifting and transporting a truck trailer, container or the like from its side, and can readily place it on or lift it off another container, railroad car or the like, as shown in FIG. 1.

In one embodiment, a plurality of latch apparatus 200 as shown in FIG. 17, preferably four rectangularly spaced latch apparatus 200 are utilized in connection with four fixed container handles, to provide increased structural assistance to the container, for increased durability and integrity, thereby allowing for lower weight and thin wall construction of the container. Accordingly, the four latch apparatuses 200 and container handle 203 are suitably rectangular spaced at predetermined locations to expedite and simplify alignment and container handling.

Briefly, in FIG. 4, the latching mechanism 210 of FIG. 17, is shown in a latched position, defined as the upper engagement member 214 being spaced in a direction toward the lower engagement member 212 in FIG. 17. In FIG. 17, an unlatched position is shown, defined as the upper engagement member 214 being spaced away from the lower engagement member 212. However, in FIG. 17, the arm 228 is shown in a clamped or a squeezable engagement with the handle 203, which normally occurs before the latching step, as is described in more detail below, in connection with the instant method.

In FIG. 17, the upper engagement member 212 includes a moveable vice or retention bar 218 including a proximal end portion 220 coupled to a power device for moving the retention bar 218 in a vertical direction and a distal end portion 224 adapted to engage a portion of a container, preferably a container handle 203 configured to receive it. As used herein, a power device includes but is not limited to pneumatic means, electrical means coupled with corkscrew gear means and preferably a hydraulic cylinder means for moving the retention bar 218 vertically up or down.

As should be understood by those skilled in the art, many of the moving components and some of the stationary components described herein, are suitably coupled to appropriate control, monitoring circuitry and hydraulics or devices and the like, for monitoring, operating and manipulating the present invention.

Figure 20:
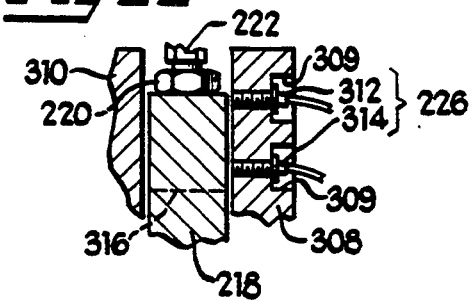
FIG. 20 is an enlarged partial, sectional view of the latch apparatus of FIG. 16 taken along the lines 20—20 of FIG. 17 showing latch sensing structure in accordance with the present invention.

As shown in FIG. 20, a latch sensing structure 226 is utilized for determining whether the latching mechanism 210 is appropriately latched with a container or not. The latch sensing structure 226 is suitably coupled to appropriate control and/or monitoring circuitry to contribute to and expedite the operation of the instant invention. In a preferred embodiment, there are at least four latch sensing structures 226 for each of the four latch apparatus 200 at each corner, coupled to monitoring circuitry indicating whether each of the latching apparatus 200 have latched with the container handle 203 in FIGS. 15 and 17.

In a preferred embodiment, the latch sensing structure 226 includes two metal sensors 312 and 314 shown in FIG. 20. The retention bar 218 is shown in a disengaged or unlatched position in FIGS. 17 and 20. In a latched position, the proximal end portion 220 of the retention bar 218 is moved vertically downward to a positioned approximately just below the lower metallic sensor 314 in FIG. 20, in proximity to dashed line 316. In operation, if the latch sensing structure 226 senses proximal end portion 220 in proximity thereto, the mechanism is not appropriately latched or coupled to a container. In one embodiment, the circuitry coupled to the sensing structure 226 will warn and may not allow an operator to lift a container because of the unlatched or not fully latched condition. The circuitry can be designed to lock out and prevent an operator from attempting to lift a container. Conversely, if the latch sensing structure 226 does not sense a certain metallic threshold in proximity thereto, it will allow an operator to continue to operate the latch apparatus 200. In this case, the retention bar 218 is made of a metal or has a certain metallic threshold. As should be understood by those skilled in the art, other sensors can be utilized which fall within the scope of this invention.

The lower engagement member 212 includes an inwardly pointing substantially "L-shaped" arm 228 having a distal end portion 224 configured to cooperate with and be at least partially complementary with a portion of the container, such as the container handle 203, as shown in FIG. 17. In one embodiment, the retention bar 218 and arm 228 extend downwardly arid outwardly of a distal portion of the housing 208, and inwardly toward the container 202. More particularly, the arm 228 includes an elongated vertical section **229*a* and a substantially horizontally inwardly extending horizontal section 229*b*. The horizontal section 229*b* includes the upper engagement member 214 and is complementarily configured to be received at least partially by handle 203. As should be understood by those skilled in the art, the geometry of the horizontal section 229*a* and container handle receiving the section 229*a*** can vary widely. Various preferred geometries are described in detail below, with respect to the figures.

As described in more detail with respect to FIG. 12, in a preferred embodiment in FIG. 17, the apex 232 of the latch apparatus 200 and transition section 106 (shown in FIG. 12) of the container handle 203 meet to define a pick point. The latch apparatus 200 and handle 203 are configured to provide a linear, horizontal and concentrically loaded pick point which minimizes unwanted bending moments, thereby contributing to minimizing the possibility of failure of such structure.

The retention bar 218, arm 228 and pin device 354 can be made of any material which can support and withstand the severe loads, forces and stress they will be subjected to. In one embodiment, the material is metallic for substantial structural integrity, and preferably an alloy steel, such as AISI/SAE 4150 for the desirable physical properties and a long useful life. Also, in a preferred embodiment, the alloy includes at least Carbon, Manganese, Chromium, Molybdenum, Phosphorus, Sulphur and Silicon.

In one embodiment, the latching mechanism 210 further includes position sensing structure 234 for determining whether the latching mechanism 210 is appropriately positioned with respect to a container 202 and handle 203. Stated another way, the position sensing structure 234 works in conjunction with vicing proximity sensor 322, to indicate whether or not the vicing step has been completed, and if so, allows the operator to continue. In one embodiment, the position sensing structure 234 includes a metal detecting sensor suitably coupled to appropriate control and monitoring circuitry, for sensing whether the lower engagable member 212 is appropriately located in proximity to the container 202 and container handle 203. The position sensing structure 234 and associated circuitry can be coupled with monitoring devices to expedite the handling of a container, by facilitating the alignment of each arm 228 with each container handle 203, there being four such arms 228 and handles 203 rectangularly spaced in a preferred embodiment. This circuitry helps an operator to determine if each of the four arms 228 are aligned and have been inwardly (horizontally) clamped, thereby securely squeezing the container 202 at four points, to allow the vertical latching step to proceed.

Figure 16:
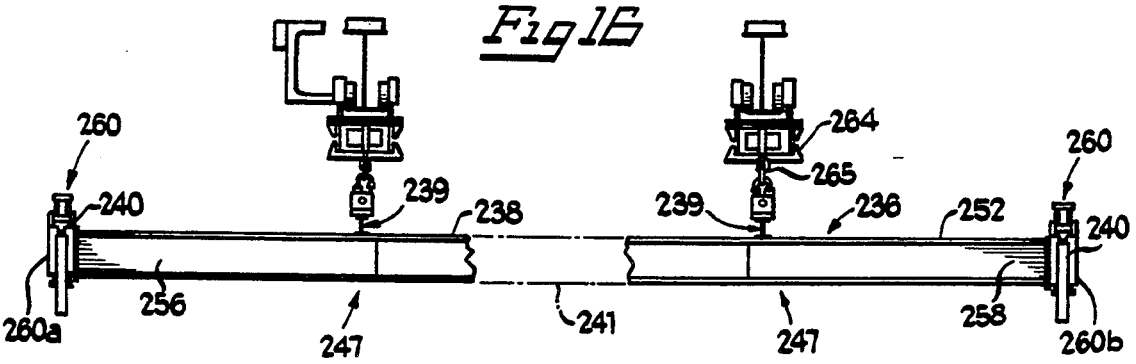
FIG. 16 is a side elevational view of a hoisting attachment, partially cut away, accompanied with four releasable latch apparatus at the end corner portions thereof, coupled to a lifting mechanism in the form of a direct hanging chain, similar to the one shown in FIG. 1, and in accordance with the present invention.
Figure 25:
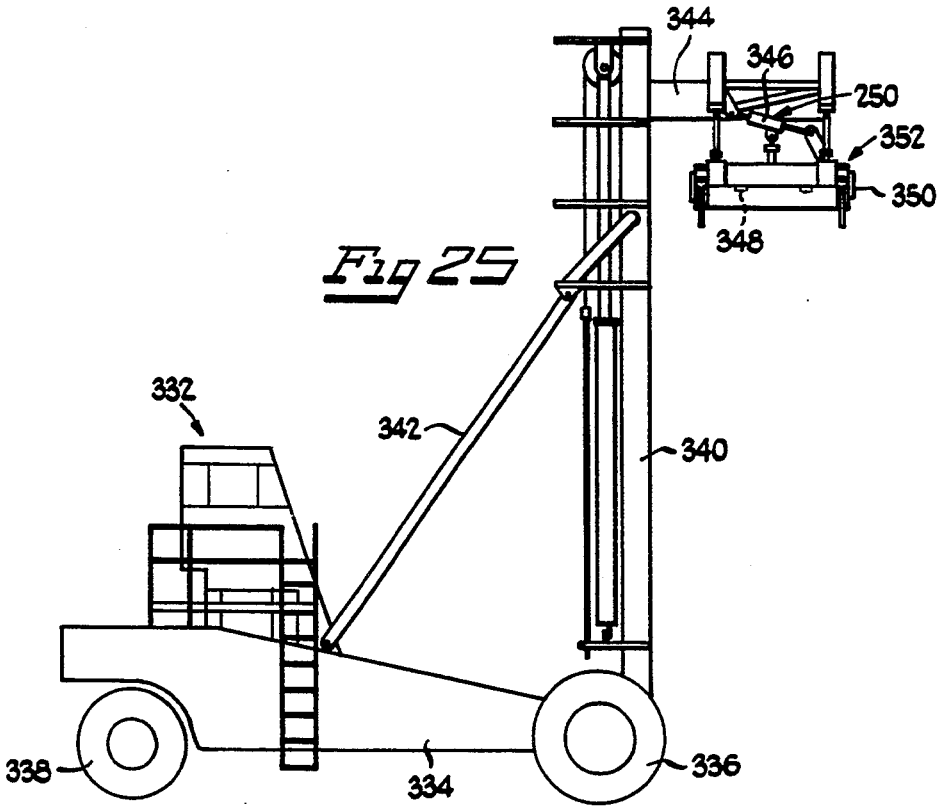
FIG. 25 is a side elevational of a lifting apparatus in the form of a front end loader, including the hoisting attachment and the latching mechanism of the instant invention for coupling with and being securely affixed to a container at four predetermined locations on a container in accordance with the present invention.

Referring to FIG. 16, a hoisting attachment 236 for use with a lifting apparatus and for releasable connection with a container having a lower engagable portion and an upper engagable portion is shown. The hoisting attachment 236 comprises framing structure 238 for coupling to a lifting apparatus end a releasable latching mechanism 240 for releasable latching engagement with a container, including a lower engagement member 212 and an upper engagement member 214 as shown in FIG. 17, adapted for cooperating with the respective lower and upper engagable portions 204 and 206 of a container, for releasably gripping a container, coupled to the framing structure 238. A preferred lifting apparatus can include but is not limited to a gantry crane 242 as partially shown in FIG. 15 or a front end loader 332 as shown in FIG. 25 or the like. In a preferred embodiment, the hoisting attachment 236 includes four latching mechanisms spaced in a relationship resembling the corners of a rectangle, for expediting container handling and alignment with a container.

Figure 22:
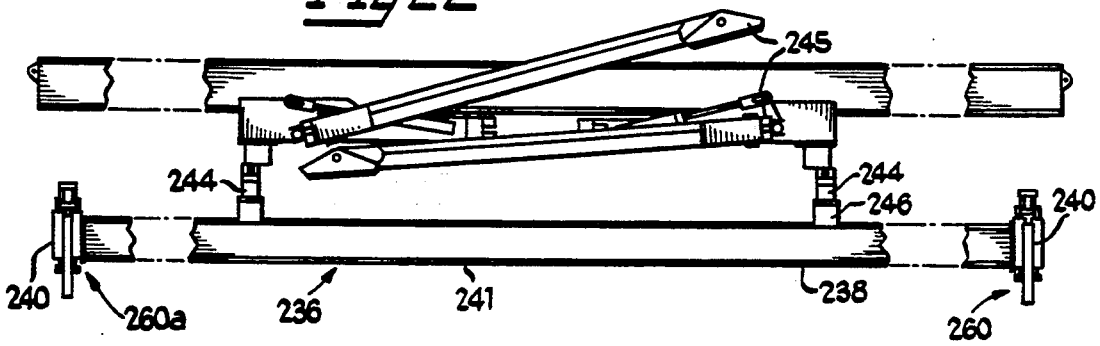
FIG. 22 is a side elevational view of an alternate embodiment of a hoisting attachment similar in many respects to the one shown in FIG. 16, including four latching apparatus and being coupled to a lifting apparatus through twist lock receiving-coupling structure, the lifting apparatus being accompanied with a bottom lifting structure in accordance with the present invention.

The framing structure 238 includes coupling devices for coupling the framing structure 238 to the lifting apparatus, which can include and are not limited to a direct hanging chain 24 as shown in FIG. 1, a tiltable means for adjusting the tilt or height for example, as shown in FIG. 25, twist lock receiving means as shown in FIG. 22 as item 246 and the like. In a preferred embodiment, the coupling structure is spaced at intermediate positions or portions 247, inwardly of the latching mechanisms 240 in FIG. 16 between the end portions and middle portion 241, for secure attachment to a lifting apparatus. Also, preferably, four substantially equi-spaced upwardly facing and extending couplings are positioned at intermediate portions 247, for stability, integrity, balanced loading and improved control of the hoisting attachment 236 and container to be handled.

Figure 23:
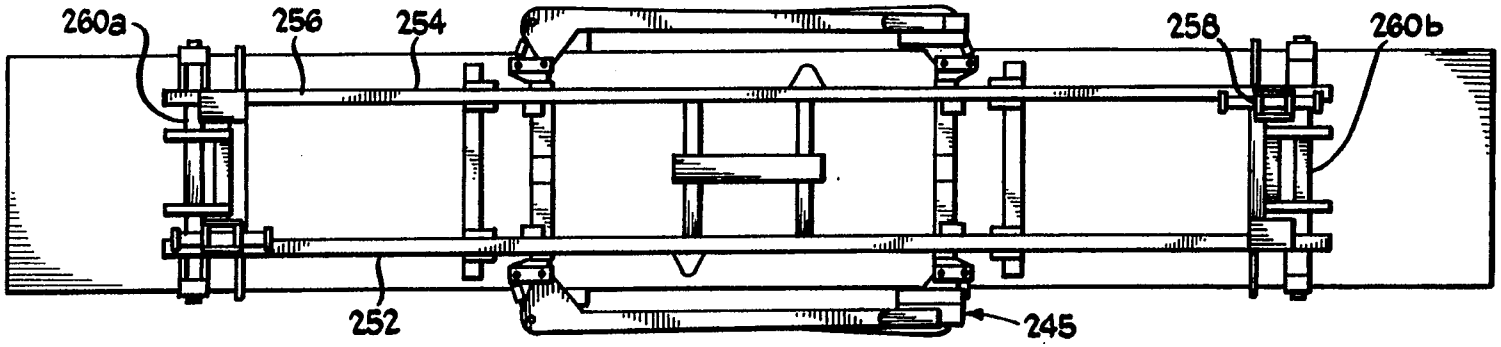
FIG. 23 is a top plan view of an alternate embodiment of a hoisting attachment, including structure for allowing the latching apparatus to be pivotably stowed or moved into a working position for allowing an operator to utilize the latching apparatus of the instant invention, conventional twist locking mechanism or bottom picking structure, showing the latching apparatus in a working position coupled to a container, in accordance with the present invention.

As shown in FIG. 23, the framing structure 238 includes front and rear lateral supports 239, such as I-beams, and left and right elongated slave bars 252 and 254 extending longitudinally interconnected at the intermediate portions 247 thereof. Each bar 252 and 254 has a front and rear end portion 256 and 258. In one embodiment, the framing structure 238 includes retractable interconnecting device 260 extending laterally and coupled to the bars 252 and 254, for positioning the releasable latching mechanism 240 with respect to a container. In a preferred embodiment, the retractable interconnecting 260 includes telescopic or pivotable adjustment structure for reliable and durable positioning into or out of service.

In one embodiment, the hoisting attachment 236 includes one retractable interconnecting device centered in a middle portion 241 of the framing structure 238, adapted to pick up and transport containers having handles in the middle portion thereof.

In a preferred embodiment, the hoisting attachment 236 includes a front and rear retractable interconnecting devices **260*a* and 260*b*, each with two tandem latching apparatus 200**, for reliably lifting and transporting containers with four pick points. The pick points on each side of the container can be spaced about 40 feet on each side and approximately the width of the container or more, for efficient alignment, positioning and handling.

In one embodiment, the framing structure 238 further includes a means for positioning the latching mechanism 240 in proximity to a container or stowing the latching mechanisms 240. For example, the positioning structure shown in FIG. 24 includes pivotable interconnectable structure having a stowed position 324 and 326 when not in use and an active position 328 and 330 for use. In addition, or alternatively, the positioning structure can include retractable interconnecting structure **260*a* and 260*b* as shown in FIG. 22, having a telescopically extended position extending laterally outwardly of the frame structure 238 and a container in an extended position for moving the latching mechanism 240 about a container, and a retracted position telescopically retracted inwardly toward the framing structure 238** when in use to contact and transport a container to a desired location.

Referring to FIG. 16, the hoisting attachment 236 is shown coupled to a trolley mechanism 264 by a direct hanging chain 265. In FIGS. 15 and 22, the hoisting attachment 236 is attached by four twist lock couplings 244, and in FIG. 25, by tiltable means. As should be understood by those skilled in the art, the hoisting attachment 236 can be coupled to a lifting apparatus in a variety of ways while still being within the scope of this invention.

In one embodiment, the framing structure 238 is configured to expedite the handling of containers. More particularly, the framing structure 238 includes four latching mechanisms 210 which can be readily and easily positioned in a substantial vertical alignment with the container handles 203 for use.

In use, the lower engagement member 212 is vertically aligned with the lower engagable portion 204 so that substantially most of the tension or pulling or supporting forces are substantially vertically aligned through and parallel to the container side walls, to minimize any unwanted bending moments or deformations to the container. In a preferred embodiment, it is believed that the unwanted bending moments are minimized when the lower and upper engagable portions 204 and 206 are interconnected with the lower and upper engagement members 212 and 214, respectively, and the supporting forces when loaded run parallel and substantially through the dashed line 216 and parallel to the container 202 side walls. Thus, the hoisting attachment 236 described herein in conjunction with the four fixed handles, provide increased structural assistance to the container, for increased durability, longevity and integrity, and allows for lower weight and thinner wall construction of the container for improved fuel savings.

The latch apparatus 200 in FIG. 17 further includes a substantially rectangular housing 208 which includes a proximal section 268 and an distal section 270. The housing 208 further includes an external-outer section 272 and a slidable, telescopic interior section 274 partially received within the outer section 272. The outer section 272 includes upper first and second carriages 276 and 278 and lower third and fourth carriages 280 and 282 opposite the first and second carriages 276 and 278, to provide a means for allowing the interior section 274 to telescopically move there along within very narrow tolerances for improved alignment of latch apparatus 200 with a container. The carriages 276, 278, 280 and 282 are attached to the interior of the outer section 272 at an upper and lower section 273*a* and 273*b* thereof, respectively. The housing 208 further includes an upper rail 284 and a lower rail 286 configured to be at least partially slidably received within first and second carriages 276 and 278 and third and fourth carriages 280 and 282, respectively, for accurate, lateral, horizontal travel within very narrow tolerances for precise movement and alignment.

As shown in FIG. 17, the housing 208 further includes a power means in the form of a hydraulic cylinder 288 attached at one end to the proximal section 268 and the other (distal) end to a clevis 290 coupled to the interior section 274. The hydraulic cylinder 288 is shown in a retracted position causing the latch mechanism 210 to clamp inwardly, and squeezably contact the container handle 203. In an extended position, the interior section 274 is moved outwardly (to the right in FIG. 17) by actuating the hydraulic cylinder 288, thereby moving the latching mechanism 210 out of contact with container 202.

Figure 18:
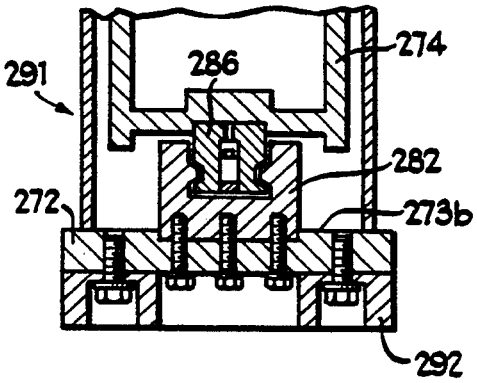
FIG. 18 is an enlarged partial sectional view of the latch apparatus of FIG. 16 taken along the lines 18—18 of FIG. 17 showing certain aspects of the retractable interconnecting device, including the telescopic interaction of the slidable interior section, guidance system and the outer section in accordance with the present invention.

In FIG. 18, a partial sectional view of a linear-elongated guidance system 291 for latching apparatus 200 is shown. More particularly, a portion of the slidable interior section 274 coupled with lower rail 286 and the fourth carriage 282 coupled with lower section 273*b* of the outer section 272 is shown. As shown in FIG. 18, the lower rail 286 and carriage 282 are at least partially complementary, to allow the interior section 274 and rail 286 to freely move telescopically within the outer section 272 within narrow tolerances.

Figure 18A:
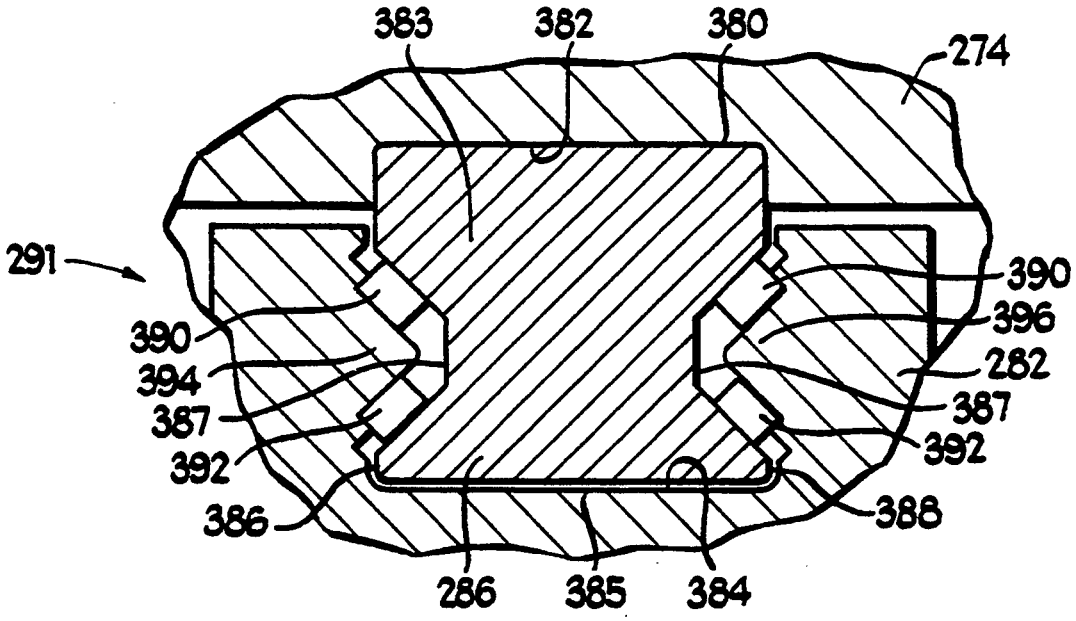
FIG. 18*a* is an enlarged partial sectional view of the latch apparatus in FIG. 18 in accordance with the present invention.

The guidance system 291 shown in FIGS. 17 and 18 and 18*a*, is configured to minimize any unwanted slop, misalignment rotation or the like of the interior section 274 with respect to the outer section 272, thereby producing a tight, telescopic linear guide system within extremely tight tolerances, while providing a smooth telescopic slidable movement for improved operation and alignment of the latching apparatus 200 with container handle 203. The carriages 276, 278, 280 and 282 define a linear bearing system which minimizes wear, friction, slop, and unwanted rotation of interior section 274 with respect to outer section 272, while providing a long useful life which can withstand the harsh environments to which it is exposed to.

In one embodiment, the side-latch hoisting attachment 236 of FIG. 16 is adapted for use with the lifting apparatus 200 for releasable connection with a container accompanied with container handles having a lower engagable portion, the attachment 236 includes framing structure for coupling to a lifting apparatus and supporting a plurality of laterally spaced latching mechanisms 240 for releasably transporting a container, the lateral distance between said latching mechanism 240 defining a predetermined width; each of the latching mechanisms 240 includes arms 228 having a lower engagable member 212; at least one, and preferably two, retractable interconnecting devices 260 for varying the width between the latching mechanisms 240 and interconnecting the latching mechanism 240 with a container; and the lower engagable member 212 being adapted for engaging at least a portion of the lower engagable portion of the container handle for releasably transporting a container to a desired location.

In a preferred embodiment the retractable interconnecting devices 260 each include linear guidance systems 291 for linear-transverse guidance thereof, and linear carriages 276, 278, 280 and 282 therealong.

Referring to FIG. 18 and 18*a*, in a preferred embodiment the guidance system 291 includes a rail 286 including a planar upper section 380 adapted and complementarily configured to be received in a keyway 382 of interior section 274, a middle section 383, and a planar lower section 384 complementarily configured and spaced adjacent to a carriage section 385 of carriage 282, opposite the upper section 380. The middle section 383 includes a first and second side portions 386 and 388 with grooves 387 and 389, respectively. Adjacent grooves 387 and 389, are a plurality of elongated upper and lower bearings 390 and 392, respectively. Adjacent to bearings 380 and 392 in a direction outwardly thereof, is first and second side portions 394 and 396 of carriage 282. As shown in FIG. 18*a*, the first and second side portions 386 and 388 of rail 286 are adapted and configured to receive a portion of first and second side portions 386 and 388 of rail 286 are adapted and configured to receive a portion of first and second side portions 394 and 396 of carriage 282, respectively.

The guidance system 291 provides high rigidity, improved static and dynamic load carrying capacity, carriage means for running smoothly inwardly and outwardly, and substantial enclosure of the carriages. These features result in extending the Longevity of the system. The geometry and high rigidity of the system 281 provide improved vibration behavior with smaller unwanted amplitudes and longer edge or side lives without slop.

The overall rigidity and accuracy of the system 291 is enhanced by the overall geometry of the rail 286 and carriage 282, as well as the upper and lower roller bearings 390 and 392 rolling across and between smooth surfaces. The roller geometry allows the force vectors to intersect outside, far from the rail center, allowing heavy loading by moments and forces acting in various directions. Further, the roller geometry provides a flat and larger contact area, than circular ball bearings, which results in a substantially higher load carrying capacity and lower wear together with minimal rolling friction.

The smooth running of the guidance system 291 is attributed to the overall geometry of the system, as well as the rail, bearing and carriage construction. It is believed that minimized guideway travel pulsation and substantial uniform translations of forces are important considerations in selecting the guidance system 291 herein.

Each carriage system is substantially enclosed to protect the rollers and rail surfaces from contaminants, as well as to minimizing lubrication loss.

The rail and carriages described herein are available from Schneeberger, Inc., 11 Deangelo Drive, Bedford, Mass. 01730.

Also in a preferred embodiment, each latching apparatus 200 includes the guidance system 291 and upper and lower rails 284 and 286 for minimal unwanted rotation and precise tranverse and horizontal movement.

Further, this embodiment includes at least one retractable interconnecting device 260 including two tandem latching apparatus, and more preferably dual interconnecting devices 260 including and more preferably dual interconnecting devices 260 including a front and rear device 260 and **260*b*** for reliable lifting and transporting of containers.

In FIG. 18, the exterior section 272 of the housing 208 further includes a bottom section with a wear pad 292. The wear pad can comprise a material that is resilient and durable, and which minimizes the possibility of scratching or damaging the header of a container, such as a polyolefin material.

Figure 19:
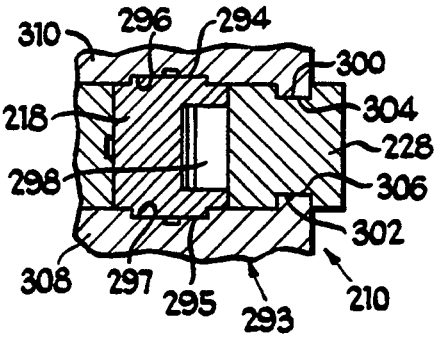
FIG. 19 is an enlarged partial sectional view of the latch apparatus of FIG. 17 taken along the lines 19—19 of FIG. 17 showing a portion of the retention bar and arm in accordance with the present invention.

In FIG. 19, a partial cross-sectional view of a middle portion 293 of the latching mechanism 210 is shown. The retention bar 218 includes outwardly extending longitudinal first and second flanges 294 and 295 which are received in first and second complementary configured key sections 296 and 297, for guiding the bar 218 vertically within narrow tolerances, respectively. Positioned partially between retention bar 218 and the arm 228 is an alignment pad 298, preferable made of a resilient and durable material which will minimize scratching or damage to a container, such as a polyolefin material.

In one embodiment, the alignment pad 298 and wear pad 292 comprise the same material. It is desirable, that the material is: wear and abrasive resist, corrosion resistant, light weight, has high impact resistance, has low friction qualities, has non-galling characteristics and the like. In a preferred embodiment, Nylatron®, type GSM and Nycast, type MOS2 are preferred materials for use in this invention for their durability, resilience without permanent deformation and soft and slidable characteristics for minimizing the possibility of scratching or damaging the side walls or header of a container.

Nylatron®GSM nylon is a high strength monomer cast nylon containing finely divided particles of molybdenum disulphide dispersed throughout for added surface lubricity. Nycast MOS2 is a molybdenum disulphide filed Type 8 cast nylon, available from Konrady Plastics, Inc., 1845 West 37th Avenue, Gary, Ind. 46408.

The cross-section in FIG. 19, shows arm 228 at middle portion 293 as generally "H-shaped", for a secure interconnection with housing 208 of latch apparatus 200. More particularly, the arm 228 includes first and second keyways 304 and 306 configured to receive first and second flanges 300 and 302 of squash plates 308 and 310, respectively. The squash plates align and enclose many of the components within the latching mechanism 210.

In FIG. 20, the proximal end portion 220 of the retention bar 218 is shown between the squash plates 308 and 310 of the latch apparatus 200. The squash plate 308 includes ports 309 for receiving sensing structure 226, for determining the location of the proximal end portion 220, thereby determining whether or not the latching mechanism 210 is latched to a container. More particularly, the latch sensing structure 226 includes a first-upper and second-lower sensor 312 and 314. In operation, when the power structure 222, such as a hydraulic cylinder, is actuated, the proximal end portion 220 of the retention bar 218 is moved downwardly, approximately to the position shown by dashed line 316, thereby appropriately latching, coupling or squeezing onto a portion of a container.

In a preferred embodiment, the first and second sensors 312 and 314 comprise metallic sensors suitably connected to control and/or monitoring circuitry for expediting and facilitating the handling of containers. When the proximal end portion 220 is moved in proximity to the dashed line 316, the sensors do not sense a certain metallic threshold at proximal end portion 220, thereby sensing the latching step has been completed and allowing the next step to proceed, such as transporting and releasing the container to a desired location. If the sensors 312 and 314 continue to sense the proximal end portion 316, the power structure 222 has not moved the retention bar 218 approximately, for example where the dashed line 316 is shown, and prevention or monitoring circuitry can prevent or indicate that the next step in the sequence should not proceed.

Figure 21:
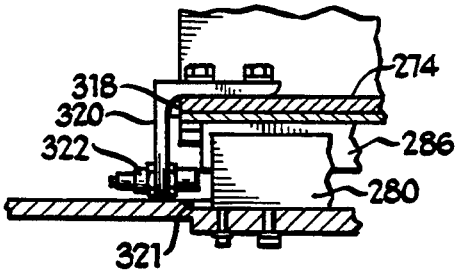
FIG. 21 is an enlarged partial sectional view of the latch apparatus of FIG. 16 showing position sensing structure and a proximal end of a slidable interior section in an extended position in accordance with the present invention.

In contrast to FIG. 17 which shows the latch mechanism 210 contacting and clamping horizontally inwardly a portion of container 202, in FIG. 21, the latch mechanism 210 is in an extended position spaced outwardly of and away from the container 202. In FIG. 21, a proximal end section 318 of the slidable interior section 274, is shown. The proximal end 318 includes an L-shaped stopper 320 including a port 321 for receiving a position sensing sensor 322 there through. When the interior section 274 is moved to an extended position, the sensor 322 moves telescopically in proximity to the third carriage 280. In a preferred embodiment, the sensor 322 is a metal detecting sensor which when moved in proximity to third carriage 280, senses a certain metallic threshold which sends a signal to the control circuitry to prevent the interior section 274 from moving further in an outwardly direction. As should be understood, alternate equivalent sensing means can be utilized which fall within the scope of this invention.

The instant invention also discloses a side latch interconnect system or method of transporting a container, comprising positioning a lifting apparatus in proximity to a container, latching the container in a substantially vertical direction with a plurality of releasable latching devices and transporting and releasing the latched container to a desired location.

In one embodiment, the positioning step further includes aligning the releasable latching mechanism in a substantially vertical direction with respect to a container, and thereafter clamping the container by adjusting the width defined as the distance between the tandem latching means in a substantially horizontal-inwardly direction. In one embodiment, there is a front and a rear retractable interconnecting device 260 each including two tandem latching mechanisms 200. In a preferred embodiment, the latching step includes latching all of the latching mechanisms sufficiently to provide a plurality of substantially vertical "C-clamp like" engagements, at four points.

In one embodiment, the latching step includes sensing whether the latching means is appropriately latched with a container, and if so, allowing the transportation step to proceed and if not, to discontinue the next step in this sequence.

Also in one embodiment, the positioning step includes pivoting the latching means from a stowed position to a working position. The stowed position is defined as being out of the way for allowing the lifting device to be utilized without interference from the latch apparatus 200, for allowing an operator to utilize the twist lock mechanism 244 or bottom lift device 245 with certain containers or trailers.

In one embodiment, a position sensing step determines whether the lifting apparatus is appropriately positioned in proximity to the container, and if so, allows the latching step in the instant sequence to proceed, and if not, to prevent the continuation of the sequence of steps as described herein.

Figure 24:
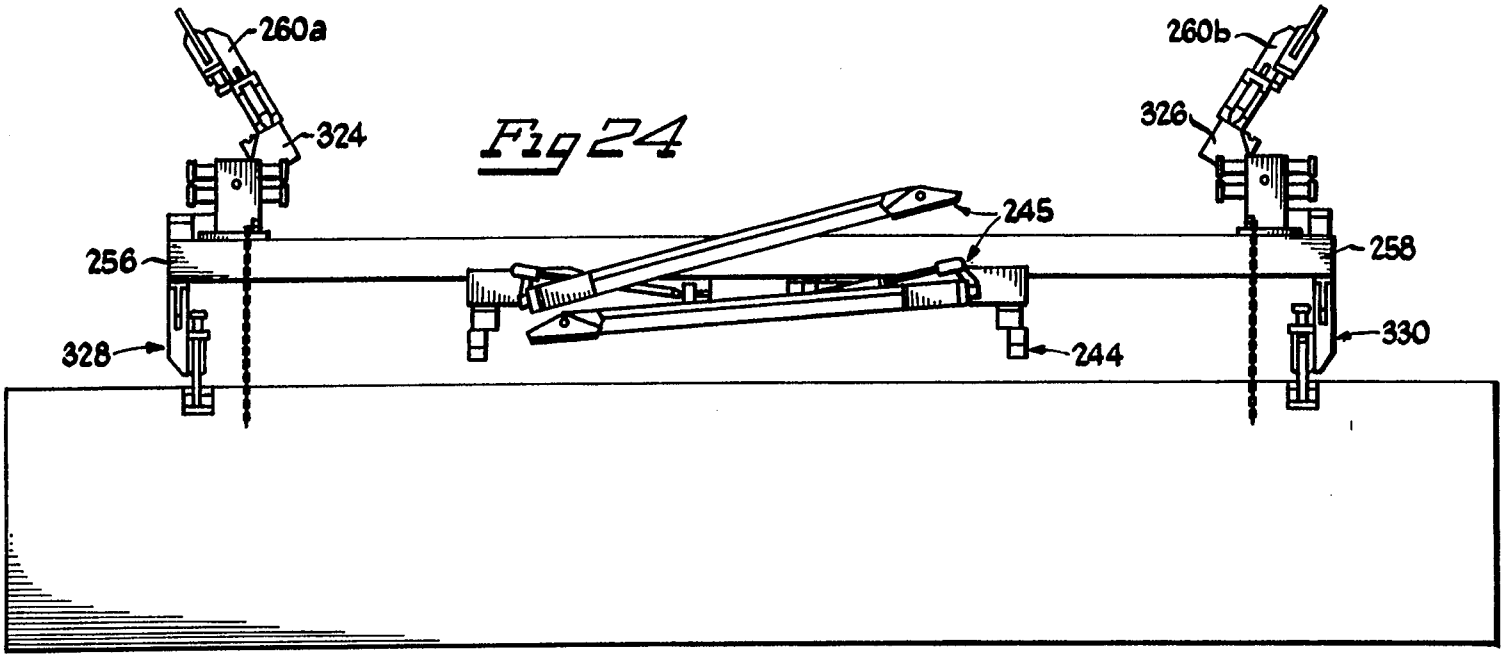
FIG. 24 is an enlarged side elevational view of the hoisting attachment in FIG. 23, wherein two tandem latching apparatus are shown, with one in the front and one in the rear, showing both latching apparatus in a stowed position pointing upwardly and in a working position pointing downwardly for use in transporting a container, in accordance with the present invention.

In FIGS. 22, 23 and 24, the hoisting attachment 236 is shown, accompanied with conventional mechanisms, such as twist lock mechanisms 244 and bottom lift device 245, (the latter in a stowed portion), for handling trailers on freight cars (TOFC) with bottom lifting device 245 and containers on freight cars (COFC) with twist lock receiving means, for example.

In FIG. 22, the framing structure 238 is coupled to conventional horizontal beams of a crane, with four twist locks 244, by a twist lock receiving-coupling structure 246.

In FIG. 23, the hoisting attachment 236 is shown having left and right elongated-longitudinal slave bars 252 and 254, each with a front and rear end portion 256 and 258. The front and rear portions 256 and 258 each has a front and rear retractable interconnecting device 260*a* and 260*b*. Each retractable interconnecting device includes two-tandem latch apparatus 200 which are mirror images of each other.

In FIG. 24, the interconnecting devices 260*a* and 260*b* include a respective front and rear pivotable interconnectable mechanisms 324 and 326 shown in a stowed position pointing at least partially upwardly, and shown in an operable position 328 and 330 pointed downwardly for transporting a container, respectively. The stowed position allows an operator to stow the retractable interconnecting device 260 with latch apparatus 200 when not in use, while allowing him or her to utilize the twist lock mechanism 244 or bottom lift devices 245.

In FIG. 25, a lifting apparatus in the form of a front end loader 332 (fork lift) is shown. Briefly, front end loader 322 includes a chassis 334, front and steerable rear tires 336 and 338, an upwardly extending mast section 340, a reinforcement mechanism 342 coupled between the mast section 340 and chassis 334, an elevatable mechanism 344 coupled to mast section 340 and a tiltable mechanism 346 coupled to the elevatable mechanism 344 for tilting a container. In one embodiment, the elevatable mechanism 344 can further include a twist locking mechanism and a bottom pick device. In one embodiment, the front end loader 332 is a Piggy Packer, model MJM-90R, available from Mi-Jack Products, Inc., 3111 West 167th Street, Hazel Crest, Ill. 60429.

In a preferred embodiment, a hoisting attachment 352 in FIG. 25, is coupled to the elevatable mechanism 344 in any suitable manner, such as with a twist lock device 348, direct hanging chain, or preferably through tiltable section 346 or power means 250. The twist lock 348 and bottom pick device 350 are in a stowed position. In this embodiment, the hoisting attachment 352 includes substantially all of the structure regarding the latch apparatus 200 and hoisting attachment 236, previously discussed. Preferably, the front end loader 332 includes four latch apparatus 200 and front and rear retractable interconnecting devices 260*a* and 260*b*.

Figure 26:
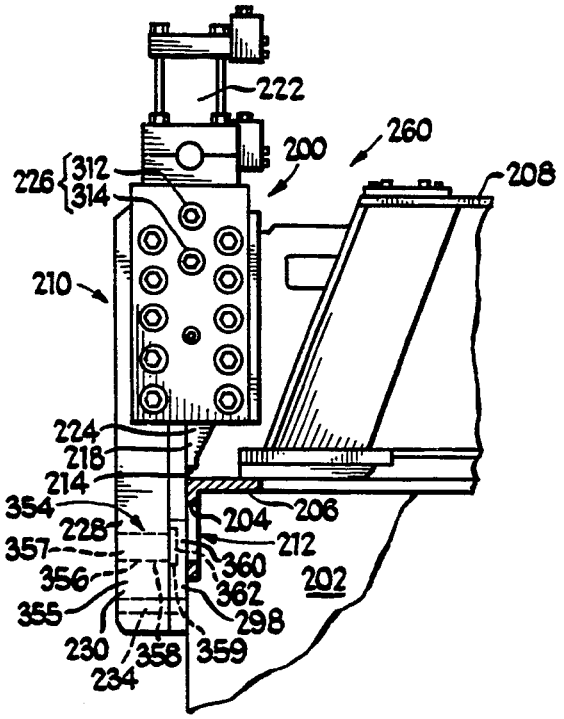
FIG. 26 is an enlarged partial view of an alternate embodiment of a latch apparatus and a cross-sectional view of an alternate embodiment of a container handle, showing the releasable latch apparatus contacting the container handle, but not yet in a fully engaged position in accordance with the present invention.

Referring to FIG. 26, an alternate latch apparatus 200 is shown. More specifically, the position sensing structure 234 is located in proximity to the end of the distal end portion 230. Positioned upstream thereof, at an intermediate section 355 between the middle portion 293 and distal end portion 230, is an elongated and inwardly facing pin device 354, extending substantially horizontally, perpendicularly and inwardly of the arm 228. The pin device 354 includes a proximal portion 356 suitably attached to arm 228 in a direction facing a container, a middle portion 358 and a distal portion 360 having the outwardly extending head portion 362 including an upper engagement member 214. The geometric shape of the pin device 354 as well as the head portion 362 can vary greatly. For example, the pin 354 and head portion 362 can be rectangular, square, triangular, polygonal, tubular and the like and preferably circular for ease of positioning and mating with a corner casting or container handle configured to receive it, such as the one shown in FIG. 27.

In a preferred embodiment, the proximal and middle portions 356 and 358 have threads which can be suitably secured into an opening 357 of arm 228 adapted to receive pin device 354. Also preferred, a locking bolt 354 securely locks pin device 354 to arm 228.

Figure 27:
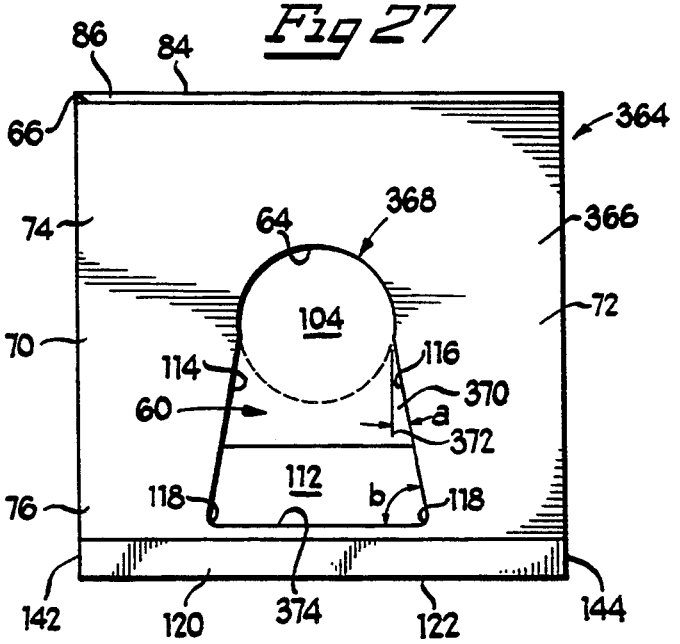
FIG. 27 is a front elevational view of the container handle shown in FIG. 26 in accordance with the present invention.

Shown in FIG. 27, is an alternate embodiment of, a container handle 364 adapted to receive the pin device 354 in FIG. 26. The container handle 364 includes most of the structure previously described with respect to the container handles 32 and 52 Thus, the same item numbers are utilized to describe certain structure shared in handles 32, 52 and 364, and such structure is utilized, for the same reasons previously discussed with respect to the aforementioned container handles. The container handle 364 includes an outwardly facing surface 366, which includes a recess 60 which is complementarily configured to receive the pin head portion 362 of FIG. 26.

Figure 28:
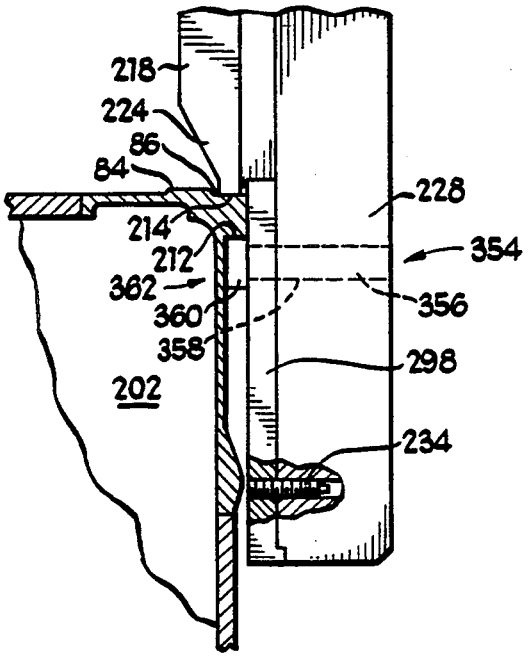
FIG. 28 is a partial enlarged view of the latch mechanism and container handle in an engaged position in accordance with the present invention.

As shown in FIGS. 26, 27 and 28, the container handle 364 is shown mounted on a container and is used with a releasable latch mechanism 210 having at least a lower engagement member 212. The container handle 364 includes, a body 54 including a substantially vertical member 58 having an outwardly facing surface 366 having a lower engagable portion 204 having a lower engagement surface, said lower engagable portion 204 adapted for cooperating with the lower engagement member 212 of the latch mechanism 210 for releasably gripping the handle 364 and facilitating the transportation of a container.

In a preferred embodiment, the outwardly facing surface 366 includes an upper engagable portion having an upper engagement surface 366 adapted for cooperating with an upper engagement member 214 associated with said latch mechanism 218 for releasably gripping the handle.

As should be understood, the geometry of the head portion 362, receptacle section 368, and pocket 60 can vary widely while still being within the scope of this invention, so long as at least a portion of the head portion 362 is engagable with a portion of the container handle 364.

More particularly, the recess 60 includes a receptacle section 368 adapted to receive the head portion 362 and a transitory section 370 below the receptacle section 368 and above the inclined section 112, for contributing to steering and directing the head portion 362 into the receptacle section 368. The side sections 114 and 116 in this embodiment, can be substantially vertical or preferably, can include an angle. In one embodiment, the side sections 114 and 116 include an angle identified as "a" with a vertical axis 372 of about 60θ or less in FIG. 27, and preferably less than about 30θ or less for improved steering of the head portion 362 into receptacle section 368.

The side sections 114 and 116 include an angle with respect to a horizontal line 374 defined as where inclined section 112 meets lower portion 76. In one embodiment, the angle "b", between line 374 and side sections 114 and 116 are about 90θ or less, preferably about 30θ or more, and more preferably 60θ or more for improved alignment of the head portion 362 into receptacle section 368.

EXAMPLE

Four container handles, as shown in FIG. 6, were coupled to a 53 foot long container, as shown in FIG. 5. The handles on each sidewall of the container had a nominal 40 foot span therebetween, and were spaced equi-distances intermediately inwardly about six and one half feet from the upper corners of the sidewalls. The horizontal and vertical members 56 and 58 were securely coupled to the sidewall and header framing 110*a* and 109*a*, respectively. These handles, as well as the latching apparatus and hoisting attachment herein, were tested to demonstrate their capabilities.

The handles were made of steel having the mechanical specifications in ASTM A-36. The retention bar and arm were made of a steel alloy having the mechanical specifications of AISI/SAE 4150. The handles had the following dimensions: the height A equaled 11.5 inches; the width B equaled 8 inches; the depth C equaled 6 inches; and the thickness D equaled 1 inch, as shown in the figures.

A lifting apparatus 10 in the form of a gantry crane similar to that in FIGS. 1 and 2, was positioned to straddle over the container accompanied with four handles. The crane used was a Translift, model 1000R rubber tired gantry crane. Briefly, the gantry crane included four upright columns, wheel assemblies attached to each, cross beams, an upper portion, an elevatable horizontal stabilizer beam, and a trolley mechanism was coupled to the stabilization beam for lateral movement thereof. The trolley mechanism included a side latch interconnect system, defined as including the latch apparatus in FIGS. 16–21 and the hoisting attachment in FIG. 16, coupled by direct hanging chains.

The side latch interconnect system included four releasable latch apparatus as shown in FIG. 17, two in tandem in the front and two in the rear spaced and adapted to be interconnected with the handles in FIG. 5. Each latch apparatus included at each distal end telescopically extendable arm member for movement laterally inwardly and outwardly, as shown in FIGS. 3 and 4. Each latch apparatus included a lower engagable member and a retention bar, as fully described previously.

The container handles and latch apparatus were tested to determine their durability and reliability. The container accompanied with four handles was lifted in the following multi-step method. First, the hoisting attachment was positioned appropriately so that the four latch apparatus were in proximity to the four handles, as shown in FIGS. 3 and 5. Second, each of the latch apparatus clamped, squeezed or were retracted so that the arm portion contacted the container handle. Third, each of the upper engagement members of the retention bar were moved downwardly to apply a vector force to apply a vice-like latch, securely holding the engagable portion of the handle as shown in FIG. 4. Fourth, the container was lifted. Fifth, the container was trolleyed laterally in a horizontal direction and sometimes gantried. Sixth, the container was lowered and the vicing or latching force, applied in step three was released. Seventh, the handles were unclamped, by extending the latch apparatus outwardly and laterally away from the handles.

This multi-step method defines one cycle. The four container handles and four latching apparatus were exposed to over 4,400 of these cycles, simultaneously by lifting the container. The container handles were visually inspected after the first 1,000 cycles and again, after 2,500 cycles. The last approximately 3,900 cycles were loaded with a pay load weighing 47,700 lbs. The container weighed 9,000 lbs.

Further, the container was dragged, laterally bumped into a rail car, gantried forward and backward, inclined severely raising one side more than the other, and lifted with a chassis weighing 6,380 lbs, with the pay load and container, totalling over 63,000 lbs. to simulate and exceed field conditions. During the test, no handle failures were observed and the handle and latch apparatus interacted as designed. After both inspections, no stress cracks or abnormal wear of the handles were observed, only normal wear and abrasions were found and burnishings were observed in the recess. These tests confirmed applicant's extensive simulated computer modeling in support of the theory and materials selected for the container handle.

During a normal life for these handles, they are expected to be exposed to between 1,000 to 1,500 lift cycles over about 10 to 12 years of service. The handles were field proven and exceeded their operational requirements. The handles were exposed to and withstood more lift cycles than would normally be anticipated in their life.

The latching apparatus was observed and monitored throughout the testing, periodic visual inspections were made during the testing and after exposure to the 4,400 cycles. After the 4,400 cycles, no failures were observed and the latch apparatus and handles interacted as designed. No stress cracks or abnormal wear of the latch apparatus were observed, only normal wear and abrasions were found. More particularly, some burnishings were observed in proximity to where the lower engagement member and apex normally contact the handle recess. In view of this testing, it is submitted that the inventive latching apparatus has been field proven to meet all operational requirements to transport containers reliably and efficiently.

In addition to the above tests, the control and/or monitoring circuitry described previously, was bypassed so as to make a three-point pick to simulate a multi-system failure. More particularly, one of the four latch arms did not engage one of the four handles and a lift of a loaded container weighing over 60,000 lbs. was made. Advantageously, the container was not dropped and no significant deformation to the container was observed.

It is believed that this test demonstrates that the inventive hoisting attachment herein, contributes to providing additional structural assistance to the container, for increased durability and integrity. This also allows for lower weight and thinner wall construction of a container for fuel and manufacturing savings.

It is further believed, that the construction and geometry of the lower engagable portion and the apex of the lower engagable member of the arm, thus defining a linear and longitudinal pick point shown in FIG. 12, contributed to allowing the inventive container, handle, latch apparatus and hoisting apparatus to withstand the simulated failure by not dropping the container and by not substantially deforming the container, by minimizing unwanted bending moments and maximizing concentric vertical loading. Accordingly, it is submitted that the inventions described herein withstood a simulated failure and exceeded normal field conditions.

Although various embodiments of this invention have been shown and described, it is to be understood that various modifications and substitutions as well as rearrangements and combinations of the preceding embodiments can be made by those skilled in the art without departing from the novel spirit and scope of this invention.

What is claimed is

1. A releasable latch apparatus for releasable connection to a side of a container having a lower engagable portion and an upper engagable portion, comprising:

a substantially rectangular framing structure adapted for coupling to a container lifting device, said framing structure includes slave bars extending longitudinally;

latching means for releasable latching onto a side of a container to provide a substantially vertical vice grip-like engagement, including a lower engagement member and an upper engagement member adapted for cooperating with the respective lower and upper engagable portions on the side of the container for releasably gripping a container, operably coupled to and extending substantially downwardly and inwardly from the framing structure to sufficiently reach a side portion of the container substantially minimally or without extending into the cargo space of the container; and front and rear retractable interconnectable means for lateral adjustment of the latching means with respect to the framing structure, including a middle portion coupled to said framing structure and end portions coupled to a plurality of said latching means, defining tandem latching means, whereby a container is handlable from its sides.

2. The apparatus of claim 1, wherein said upper engagement member and said lower engagement member of said latching means are substantially vertically aligned with respect to each other.

3. The apparatus of claim 1, wherein said latching means includes a latched position defined as said upper engagement member being spaced in a direction toward the lower engagement member and an unlatched position defined as said upper engagement member being spaced away from the lower engagement member.

4. The apparatus of claim 1, wherein said upper engagement member includes a moveable retention bar including a proximal end coupled to power means for moving the retention bar and a distal end adapted to engage a portion of a container.

5. The apparatus of claim 1, wherein said latching means includes sensing means for determining whether the latching means is latched with a container and position sensing means for determining whether the latching means is appropriately positioned with respect to a container.

6. The apparatus of claim 1, wherein said lower engagement member includes a substantially "L-shaped" arm having a distal end portion configured to cooperate with and be at least partially complementary with a portion of the container.

7. A hoisting attachment for use with a lifting apparatus and for releasable connection to an exterior side of a container having a lower engagable portion and an upper engagable portion, comprising:

(a) elongated framing structure for coupling to a lifting apparatus and being capable of moving vertically while maintaining a horizontal posture, said framing structure includes slave bars extending longitudinally and having end portions;

(b) latching means for releasable latching with a side of a container including a generally L-shaped arm extending substantially downwardly having a lower engagement member defining a support surface extending substantially inwardly and a movable vice bar having a distal end with an upper engagement member, adapted for cooperating with the respective lower and upper engagable portions of the container for releasably gripping the container from the side; and (c) front and rear retractable clamping means for lateral movement and adjustment of the latching means with respect to the framing structure, and each retractable clamping means including a left and a right side latching means for positioning the latchings means in proximity to a side portion of the container, said front and said rear retractable clamping means extending substantially laterally and including a middle portion coupled to said frame structure and end portions coupled to the left and the right latching means, whereby a container is handlable from its sides.

8. The hoisting attachment of claim 7, wherein said latching means is adapted for releasably engaging the container having handles including a lower engagable portion and an upper engagable portion, said lower and said upper engagement members of said latching means cooperating with said lower and upper engagable portions of said handles for releasably gripping the container.

9. The hoisting attachment of claim 7, further comprising means for coupling the framing structure and the lifting apparatus, and wherein said lifting apparatus comprises a gantry crane or a front end loader.

10. The hoisting attachment of claim 7, wherein said framing means includes slave bars extending longitudinally and having end portions, each end portion including front and rear retractable clamping means for positioning the latching means in proximity to a side of the container, each retractable clamping means including tandem latching means defined by a left and right side latching means.

11. The hoisting attachment of claim 7, wherein said framing structure includes positioning means for positioning the latching means in proximity to a container.

12. A hoisting attachment for use with a lifting apparatus and for releasable connection to an exterior side of a container having a lower engagable portion and an upper engagable portion, comprising;

(a) elongated framing means for coupling to a lifting apparatus and being movable vertically while maintaining a horizontal posture, said framing means includes slave bars extending longitudinally;

(b) latching means for releasable latching with a side of a container including a generally L-shaped arm having a lower engagement member defining a support surface and a movable vice bar having a distal end with an upper engagement member, adapted for cooperating with the respective lower and upper engagable portions of the container for releasably gripping the container from the side; and (c) front and rear positioning means for lateral movement and adjustment of the latching means with respect to the framing means, wherein said positioning means include at least one retractable clamping means comprising two latching means having an extended position extending outwardly of said framing means and a retracted position retracted inwardly toward the framing means, or pivotable interconnectable means comprising two latching means having a stowed position when not in use substantially above the framing means and an active position for use substantially below the framing means, said positioning means extending substantially laterally and including a middle portion coupled to said framing means and end portions coupled to said two latching means, whereby a container is handlable from the side.

13. A side-latch hoisting attachment for use with a lifting apparatus and for releasable connection with a container having container handles on the side having a lower engagable portion, comprising:

(a) framing means for coupling to a lifting apparatus and supporting a plurality of laterally spaced latching means for releasably transporting a container, the lateral distance between said latching means defining a width;

(b) each of said latching means includes generally L-shaped substantially downwardly and inwardly extending arm means having a lower engagable member adapted to reach a side portion of a container;

(c) retractable interconnecting means for varying the width between the latching means and interconnecting the latching means with a side of the container, wherein said framing means includes elongated slave bars extending longitudinally and having end portions, said end portions each including said retractable interconnecting means for positioning the latching means in proximity to a front and a rear side portion of the container, and each of said retractable interconnecting means comprising tandem latching means defined by a left and a right side latching means;

(d) said lower engagable member of said arm means being adapted for engaging at least a portion of the lower engagable portion of the container handle from the side, for releasably transporting a container from the side to a desired location; and (e) housing means for housing a portion of the latching means coupled between the retractable interconnecting means and the arm means.

14. The hoisting attachment of claim 13, wherein said lower engagable member includes a distal end portion having at least an elongated pin device or a substantially upwardly facing member including an apex.

15. The hoisting attachment of claim 13, wherein said retractable interconnecting means includes linear guide means for linear-transverse guidance, rail means and linear carriage means for allowing the rail means to smoothly travel along said carriage means.

16. The hoisting attachment of claim 13, wherein said retractable interconnecting means has an extended position extending outwardly of said frame means and a retracted position retracted inwardly toward the framing means.

17. The hoisting attachment of claim 13, wherein said retractable interconnecting means includes pivotable means for storing the latching means in a stowed position substantially above the framing means when not in use and an active position substantially below the framing means for use.

18. A method of transporting a container, comprising:

(a) positioning a lifting apparatus having latching means for releasably latching a side of a container, in proximity to a container and clamping the container by adjusting the width, defined as the distance between latching means, in a substantially horizontal-inwardly direction;

(b) latching onto the container from the side by moving a retention bar downwardly to provide a substantially vertical vice grip-like engagement between the latching means and the retention bar substantially minimally of without intruding into the cargo space of the container; and (c) transporting and releasing the latched container to a desired location.

19. The method of claim 18, wherein the positioning step includes aligning the releasable latching means in a substantially vertical direction with respect to a container.

20. The method of claim 18, wherein the latching step includes actuating the latching means sufficiently to provide a substantially vertical C-clamp like engagement.

21. The method of claim 18, wherein the latching step includes sensing whether the latching means is appropriately latched, and if so, allowing the transportion step to proceed.

22. The method of claim 18, wherein the positioning step includes pivoting the latching means from a stowed position to a working position in proximity to a container.

23. The method of claim 18, wherein the positioning step includes sensing whether the lifting apparatus is appropriately positioned in proximity to the container, and if so, allowing the latching step to proceed.

* * * * *